US009489800B2

(12) United States Patent
Walker et al.

(10) Patent No.: US 9,489,800 B2
(45) Date of Patent: Nov. 8, 2016

(54) APPLICATIONS FOR GAMING DEVICES IN A NETWORKED ENVIRONMENT

(75) Inventors: Jay S. Walker, Ridgefield, CT (US); Matthew P. Ellenthal, Wilton, CT (US)

(73) Assignee: IGT, Las Vegas, NV (US)

( * ) Notice: Subject to any disclaimer, the term of this patent is extended or adjusted under 35 U.S.C. 154(b) by 1410 days.

(21) Appl. No.: 12/251,855

(22) Filed: Oct. 15, 2008

(65) Prior Publication Data

US 2009/0098933 A1 Apr. 16, 2009

Related U.S. Application Data

(60) Provisional application No. 60/979,995, filed on Oct. 15, 2007.

(51) Int. Cl.
*G07F 17/32* (2006.01)

(52) U.S. Cl.
CPC ..... *G07F 17/3244* (2013.01); *G07F 17/32* (2013.01)

(58) Field of Classification Search
CPC ..... G07F 17/32; G07F 17/3244; A63F 9/24
USPC ..... 463/42, 25
See application file for complete search history.

(56) References Cited

U.S. PATENT DOCUMENTS 4,467,424 A 8/1984 Hedges et al.
4,636,951 A 1/1987 Harlick
4,669,731 A 6/1987 Clarke
4,764,666 A 8/1988 Bergeron
4,880,237 A 11/1989 Kishishita
4,991,848 A 2/1991 Greenwood et al.
5,069,453 A 12/1991 Koza et al.
5,083,271 A * 1/1992 Thacher et al. ..... 700/92
5,112,050 A 5/1992 Koza et al.
5,123,649 A 6/1992 Tiberio
5,178,390 A 1/1993 Okada
5,275,400 A 1/1994 Weingardt et al.
5,287,269 A 2/1994 Dorrough
5,290,033 A 3/1994 Bittner et al.
5,324,035 A 6/1994 Morris et al.
5,377,975 A 1/1995 Clapper, Jr.
5,401,024 A 3/1995 Simunek
5,429,361 A 7/1995 Raven et al.
5,536,008 A 7/1996 Clapper, Jr.
5,551,692 A 9/1996 Pettit et al.
5,569,082 A 10/1996 Kaye
5,570,885 A 11/1996 Ornstein
5,580,311 A 12/1996 Haste, III
5,595,538 A 1/1997 Haste, III
5,609,337 A 3/1997 Clapper, Jr.
5,613,912 A 3/1997 Slater
5,621,200 A 4/1997 Irwin, Jr. et al.
5,634,012 A 5/1997 Stefik et al.
5,647,592 A 7/1997 Gerow
5,657,899 A 8/1997 Stoken
5,735,432 A 4/1998 Stoken et al.
5,741,183 A 4/1998 Acres et al.
5,749,784 A 5/1998 Clapper, Jr.

(Continued)

*Primary Examiner* — James S McClellan
*Assistant Examiner* — Syvila Weatherford
(74) *Attorney, Agent, or Firm* — Neal, Gerber & Eisenberg LLP

(57) ABSTRACT

A method comprises receiving a request from a gaming device to initiate a session of game play comprising a plurality of game plays to be played, and transmitting to the gaming device an amount of credit required to initiate a first game play of the session on the gaming device.

27 Claims, 5 Drawing Sheets

(56) References Cited

U.S. PATENT DOCUMENTS

| | | | | |
|---|---|---|---|---|
| 5,758,875 | A | 6/1998 | Giacalone, Jr. | |
| 5,766,075 | A | 6/1998 | Cook et al. | |
| 5,768,382 | A | 6/1998 | Schneier et al. | |
| 5,770,533 | A | 6/1998 | Franchi | |
| 5,772,509 | A | 6/1998 | Weiss | |
| 5,800,268 | A | 9/1998 | Molnick | |
| 5,816,917 | A | 10/1998 | Kelmer et al. | |
| 5,830,067 | A | 11/1998 | Graves et al. | |
| 5,833,538 | A | 11/1998 | Weiss | |
| 5,970,143 | A | 10/1999 | Schneier et al. | |
| 6,001,016 | A | 12/1999 | Walker et al. | |
| 6,012,983 | A | 1/2000 | Walker et al. | |
| 6,077,163 | A | 6/2000 | Walker et al. | |
| 6,168,522 | B1 | 1/2001 | Walker et al. | |
| 6,203,428 | B1 | 3/2001 | Giobbi et al. | |
| 6,244,957 | B1 | 6/2001 | Walker et al. | |
| 6,299,533 | B1 | 10/2001 | Parra et al. | |
| 6,315,662 | B1 | 11/2001 | Jorasch et al. | |
| 6,319,125 | B1 | 11/2001 | Acres | |
| 6,319,127 | B1 | 11/2001 | Walker et al. | |
| 6,343,989 | B1 | 2/2002 | Wood et al. | |
| 6,371,852 | B1 | 4/2002 | Acres | |
| 6,389,538 | B1 | 5/2002 | Gruse et al. | |
| 6,409,602 | B1 | 6/2002 | Wiltshire et al. | |
| 6,508,710 | B1 | 1/2003 | Paravia et al. | |
| 6,511,377 | B1 | 1/2003 | Weiss | |
| 6,527,638 | B1 | 3/2003 | Walker et al. | |
| 6,565,434 | B1 | 5/2003 | Acres | |
| 6,582,306 | B1 | 6/2003 | Kaminkow | |
| 6,605,001 | B1 | 8/2003 | Tarantino | |
| 6,685,563 | B1 | 2/2004 | Meekins et al. | |
| 6,709,331 | B2 | 3/2004 | Berman | |
| 6,722,983 | B2 | 4/2004 | Kaminkow et al. | |
| 6,726,563 | B1 | 4/2004 | Baerlocher et al. | |
| 6,729,961 | B1 | 5/2004 | Millerschone | |
| 6,733,389 | B2 | 5/2004 | Webb et al. | |
| 6,769,983 | B2 | 8/2004 | Slomiany | |
| 6,800,030 | B2 | 10/2004 | Acres | |
| 6,846,238 | B2 | 1/2005 | Wells | |
| 6,866,584 | B2 | 3/2005 | Michaelson | |
| 6,878,063 | B2 | 4/2005 | Manfredi et al. | |
| 6,896,616 | B2 | 5/2005 | Weiss | |
| 6,965,868 | B1 | 11/2005 | Bednarek | |
| 6,988,946 | B2 | 1/2006 | Michaelson et al. | |
| 7,063,617 | B2 | 6/2006 | Brosnan et al. | |
| 7,070,501 | B2 | 7/2006 | Cormack et al. | |
| 7,076,652 | B2 | 7/2006 | Ginter et al. | |
| 7,140,964 | B2 | 11/2006 | Walker et al. | |
| 7,192,348 | B2 | 3/2007 | Brosnan et al. | |
| 7,213,005 | B2 | 5/2007 | Mourad et al. | |
| 7,291,069 | B2 | 11/2007 | Michaelson et al. | |
| 7,329,183 | B2 | 2/2008 | Michaelson | |
| 7,387,568 | B2 | 6/2008 | Millerschone | |
| 7,390,258 | B2 | 6/2008 | Millerschone | |
| 7,393,276 | B2 | 7/2008 | Millerschone | |
| 7,399,227 | B2 | 7/2008 | Michaelson et al. | |
| 7,470,183 | B2 | 12/2008 | Wishart et al. | |
| 7,470,196 | B1 * | 12/2008 | Joshi | 463/42 |
| 7,473,176 | B2 | 1/2009 | Michaelson | |
| 7,479,062 | B2 | 1/2009 | Michaelson | |
| 7,524,243 | B2 | 4/2009 | Bansemer et al. | |
| 7,563,163 | B2 | 7/2009 | Crumby | |
| 7,628,703 | B2 | 12/2009 | Wolf et al. | |
| 7,658,672 | B1 | 2/2010 | Wolf et al. | |
| 7,785,187 | B2 | 8/2010 | Millerschone | |
| 7,785,189 | B2 | 8/2010 | Brosnan et al. | |
| 7,815,500 | B2 | 10/2010 | Montross et al. | |
| 7,833,093 | B2 | 11/2010 | Michaelson et al. | |
| 7,837,545 | B2 | 11/2010 | Blair, Jr. et al. | |
| 7,857,693 | B1 | 12/2010 | Johnson et al. | |
| 7,934,990 | B2 | 5/2011 | Walker et al. | |
| 2002/0058542 | A1 | 5/2002 | Roethel et al. | |
| 2002/0125641 | A1 | 9/2002 | Moody | |
| 2003/0073494 | A1 * | 4/2003 | Kalpakian et al. | 463/42 |
| 2003/0144053 | A1 | 7/2003 | Michaelson | |
| 2003/0148807 | A1 | 8/2003 | Acres | |
| 2003/0220138 | A1 | 11/2003 | Walker et al. | |
| 2004/0204231 | A1 * | 10/2004 | Martin et al. | 463/25 |
| 2005/0239530 | A1 | 10/2005 | Walker et al. | |
| 2006/0094509 | A1 | 5/2006 | Michaelson et al. | |
| 2006/0172791 | A1 | 8/2006 | Wolf | |
| 2006/0223608 | A1 | 10/2006 | Tedesco et al. | |
| 2006/0252508 | A1 | 11/2006 | Walker et al. | |
| 2007/0032285 | A1 | 2/2007 | Wolf | |
| 2007/0155482 | A1 | 7/2007 | Walker et al. | |
| 2007/0293306 | A1 | 12/2007 | Nee et al. | |
| 2008/0015004 | A1 * | 1/2008 | Gatto et al. | 463/16 |
| 2008/0051169 | A1 | 2/2008 | Michaelson et al. | |
| 2008/0096659 | A1 * | 4/2008 | Kreloff et al. | 463/39 |
| 2008/0182655 | A1 | 7/2008 | DeWaal et al. | |
| 2008/0254894 | A1 | 10/2008 | Michaelson et al. | |
| 2009/0048010 | A1 * | 2/2009 | Kroeckel et al. | 463/13 |
| 2009/0318214 | A1 * | 12/2009 | Acres | 463/20 |
| 2010/0227691 | A1 * | 9/2010 | Karsten | 463/42 |
| 2011/0086699 | A1 * | 4/2011 | Allen et al. | 463/25 |

* cited by examiner

APPLICATIONS FOR GAMING DEVICES IN A NETWORKED ENVIRONMENT

CROSS REFERENCE TO RELATED APPLICATIONS

This application claims the benefit of U.S. Provisional Patent Application No. 60/979,995 filed Oct. 15, 2007 entitled "APPLICATIONS FOR GAMING DEVICES IN A NETWORKED ENVIRONMENT", which is hereby incorporated by reference herein.

The present application relates to U.S. patent application Ser. No. 08/880,838 filed Jun. 23, 1997, and issued on Jun. 20, 2000 as U.S. Pat. No. 6,319,127 entitled "GAMING DEVICE FOR A FLAT RATE PLAY SESSION AND A METHOD OF OPERATING SAME".

The present application relates to U.S. patent application Ser. No. 09/518,760 filed Mar. 3, 2000, and issued as U.S. Pat. No. 6,319,127 B1 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued on Jun. 20, 2000 as U.S. Pat. No. 6,319,127 entitled "GAMING DEVICE FOR A FLAT RATE PLAY SESSION AND A METHOD OF OPERATING SAME".

The present application relates to U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to U.S. patent application Ser. No. 10/985,131 filed Nov. 10, 2004, and issued as U.S. Pat. No. 7,156,739 on Jan. 2, 2007 entitled "GAMING DEVICE FOR A FLAT RATE PLAY SESSION AND A METHOD OF OPERATING SAME" which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to pending U.S. patent application Ser. No. 10/986,529 filed Nov. 10, 2004 entitled "GAMING DEVICE FOR A FLAT RATE PLAY SESSION AND A METHOD OF OPERATING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to U.S. application Ser. No. 11/293,016 filed Dec. 2, 2005 entitled "GAMING DEVICE FOR A FLAT RATE PLAY SESSION AND A METHOD OF OPERATING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to U.S. patent application Ser. No. 11/425,037 filed Jun. 19, 2006 "entitled GAMING DEVICE FOR A FLAT RATE PLAY SESSION AND A METHOD OF OPERATING SAME", which is a continuation of U.S. application Ser. No. 11/293,016 filed Dec. 2, 2005 entitled "GAMING DEVICE FOR A FLAT RATE PLAY SESSION AND A METHOD OF OPERATING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to U.S. application Ser. No. 11/425,041 filed Jun. 19, 2006 entitled "GAMING DEVICE FOR A FLAT RATE PLAY SESSION AND A METHOD OF OPERATING SAME" and currently abandoned, which is a continuation of U.S. application Ser. No. 11/293,016 filed Dec. 2, 2005 entitled "GAMING DEVICE FOR A FLAT RATE PLAY SESSION AND A METHOD OF OPERATING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to U.S. patent application Ser. No. 11/425,044 filed Jun. 19, 2006 entitled "GAMING DEVICE FOR A FLAT RATE PLAY SESSION AND A METHOD OF OPERATING SAME" and currently abandoned, which is a continuation of U.S. application Ser. No. 11/293,016 filed Dec. 2, 2005 entitled "GAMING DEVICE FOR A FLAT RATE PLAY SESSION AND A METHOD OF OPERATING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to pending U.S. patent application Ser. No. 10/636,520 filed Aug. 7, 2003 entitled "SYSTEM AND METHOD FOR COMMUNICATING GAME SESSION INFORMATION", which is a continuation-in-part of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME" and also claims priority to U.S. Provisional Patent Application No. 60/282,792 filed Apr. 10, 200, which is a continuation-in-part of U.S. patent application Ser. No. 09/518,760 filed Mar. 3, 2000 and issued on Jun. 20, 2000 as U.S. Pat. No. 6,319,127 entitled "GAMING DEVICE FOR A FLATE RATE PLAY SESSION AND A METHOD OF OPERATING SAME"; also claims priority to U.S. Provisional Patent Application No. 60/282,792 filed Apr. 10, 2001 entitled "GAMING CONTRACTS" and also to U.S. patent application Ser. No. 10/159,722 filed May 30, 2002, and issued as U.S. Pat. No. 6,969,317 on Nov. 29, 2005 entitled "SYSTEM AND METHOD FOR AUTOMATED PLAY OF MULTIPLE GAMING DEVICES", which is a continuation of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE" and also claims priority to U.S. Provisional Applicant No. 60/401,852 filed Aug. 7, 2002 entitled "VIEWING OF GAMING CONTRACTS".

The present application relates to pending U.S. patent application Ser. No. 11/423,037 filed Jun. 8, 2006 entitled "SYSTEM AND METHOD FOR COMMUNICATING GAME SESSION INFORMATION", which is a continuation of pending U.S. patent application Ser. No. 10/636,520 filed Aug. 7, 2003 entitled "SYSTEM AND METHOD FOR COMMUNICATING GAME SESSION INFORMATION", which is a continuation-in-part of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME" and also claims priority to U.S. Provisional Patent Application No. 60/282,792 filed Apr. 10, 200, which is a continuation-in-part of U.S. patent application Ser. No. 09/518,760 filed Mar. 3, 2000 and issued on Jun. 20, 2000 as U.S. Pat. No. 6,319,127 entitled "GAMING DEVICE FOR A FLATE RATE PLAY SESSION AND A METHOD OF OPERATING SAME"; also claims priority to U.S. Provisional Patent Application No. 60/282,792 filed Apr. 10, 2001 entitled "GAMING CONTRACTS" AND ALSO TO U.S. patent application Ser. No. 10/159,722 filed May 30, 2002, and issued as U.S. Pat. No. 6,969,317 on Nov. 29, 2005 entitled "SYSTEM AND METHOD FOR AUTOMATED PLAY OF MULTIPLE GAMING DEVICES", which is a continuation of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No.

08/774,487 filed Dec. 30, 1996, and issued as U.S. Pat. No. 6,012,983 on Jan. 11, 2000 entitled "AUTOMATED PLAY GAMING DEVICE" and also claims priority to U.S. Provisional Applicant No. 60/401,852 filed Aug. 7, 2002 entitled "VIEWING OF GAMING CONTRACTS".

The present application relates to pending U.S. patent application Ser. No. 11/423,043 filed Jun. 8, 2006 entitled "SYSTEM AND METHOD FOR COMMUNICATING GAME SESSION INFORMATION", which is a continuation of pending U.S. patent application Ser. No. 10/636,520 filed Aug. 7, 2003 entitled "SYSTEM AND METHOD FOR COMMUNICATING GAME SESSION INFORMATION", which is a continuation-in-part of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME" and also claims priority to U.S. Provisional Patent Application No. 60/282,792 filed Apr. 10, 200, which is a continuation-in-part of U.S. patent application Ser. No. 09/518,760 filed Mar. 3, 2000 and issued on Jun. 20, 2000 as U.S. Pat. No. 6,319,127 entitled "GAMING DEVICE FOR A FLATE RATE PLAY SESSION AND A METHOD OF OPERATING SAME"; also claims priority to U.S. Provisional Patent Application No. 60/282,792 filed Apr. 10, 2001 entitled "GAMING CONTRACTS" AND ALSO TO U.S. patent application Ser. No. 10/159,722 filed May 30, 2002, and issued as U.S. Pat. No. 6,969,317 on Nov. 29, 2005 entitled "SYSTEM AND METHOD FOR AUTOMATED PLAY OF MULTIPLE GAMING DEVICES", which is a continuation of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE" and also claims priority to U.S. Provisional Applicant No. 60/401,852 filed Aug. 7, 2002 entitled "VIEWING OF GAMING CONTRACTS".

The present application relates to pending U.S. patent application Ser. No. 11/423,055 filed Jun. 8, 2006 entitled "SYSTEM AND METHOD FOR COMMUNICATING GAME SESSION INFORMATION", which is a continuation of U.S. patent application Ser. No. 10/636,520 filed Aug. 7, 2003 entitled "SYSTEM AND METHOD FOR COMMUNICATING GAME SESSION INFORMATION", which is a continuation-in-part of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME" and also claims priority to U.S. Provisional Patent Application No. 60/282,792 filed Apr. 10, 2001, which is a continuation-in-part of U.S. patent application Ser. No. 09/518,760 filed Mar. 3, 2000 and issued on Jun. 20, 2000 as U.S. Pat. No. 6,319,127 entitled "GAMING DEVICE FOR A FLATE RATE PLAY SESSION AND A METHOD OF OPERATING SAME"; also claims priority to U.S. Provisional Patent Application No. 60/282,792 filed Apr. 10, 2001 entitled "GAMING CONTRACTS"; and also to U.S. patent application Ser. No. 10/159,722 filed May 30, 2002, and issued as U.S. Pat. No. 6,969,317 on Nov. 29, 2005 entitled "SYSTEM AND METHOD FOR AUTOMATED PLAY OF MULTIPLE GAMING DEVICES", which is a continuation of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE" and also claims priority to U.S. Provisional Applicant No. 60/401,852 filed Aug. 7, 2002 entitled "VIEWING OF GAMING CONTRACTS".

The present application relates to pending U.S. patent application Ser. No. 10/420,066 filed Apr. 21, 2003 entitled "METHOD AND APPARATUS FOR EMPLOYING FLAT RATE", which claims priority to U.S. Provisional Patent Application No. 60/374,385 filed Apr. 19, 2002 entitled "METHOD AND APPARATUS FOR EMPLOYING FLAT RATE".

The present application relates to pending U.S. patent application Ser. No. 11/428,638 filed Jul. 5, 2006 entitled "METHOD AND APPARATUS FOR EMPLOYING FLAT RATE PLAY", which is a continuation of pending U.S. patent application Ser. No. 10/420,066 filed Apr. 21, 2003 entitled "METHOD AND APPARATUS FOR EMPLOYING FLAT RATE", which claims priority to U.S. Provisional Patent Application No. 60/374,385 filed Apr. 19, 2002 entitled "METHOD AND APPARATUS FOR EMPLOYING FLAT RATE".

The present application relates to pending U.S. patent application Ser. No. 11/428,642 filed Jul. 5, 2006 entitled "METHOD AND APPARATUS FOR EMPLOYING FLAT RATE PLAY", which is a continuation of pending U.S. patent application Ser. No. 10/420,066 filed Apr. 21, 2003 entitled "METHOD AND APPARATUS FOR EMPLOYING FLAT RATE", which claims priority to U.S. Provisional Patent Application No. 60/374,385 filed Apr. 19, 2002 entitled "METHOD AND APPARATUS FOR EMPLOYING FLAT RATE".

The present application relates to pending U.S. patent application Ser. No. 11/691,015 filed Mar. 26, 2007 entitled "METHOD AND APPARATUS FOR EMPLOYING FLAT RATE PLAY", which is a continuation of pending U.S. patent application Ser. No. 10/420,066 filed Apr. 21, 2003 entitled "METHOD AND APPARATUS FOR EMPLOYING FLAT RATE", which claims priority to U.S. Provisional Patent Application No. 60/374,385 filed Apr. 19, 2002 entitled "METHOD AND APPARATUS FOR EMPLOYING FLAT RATE"; is a continuation-in-part U.S. patent application Ser. No. 09/518,760 filed Mar. 3, 2000 and issued on Jun. 20, 2000 as U.S. Pat. No. 6,319,127 entitled "GAMING DEVICE FOR A FLATE RATE PLAY SESSION AND A METHOD OF OPERATING SAME"; also claims priority to U.S. Provisional Patent Application No. 60/282,792 filed Apr. 10, 2001 entitled "GAMING CONTRACTS".

The present application relates to pending U.S. patent application Ser. No. 11/691,065 filed Mar. 26, 2007 entitled "METHOD AND APPARATUS FOR EMPLOYING FLAT RATE PLAY", which is a continuation of pending U.S. patent application Ser. No. 10/420,066 filed Apr. 21, 2003 entitled "METHOD AND APPARATUS FOR EMPLOYING FLAT RATE", which claims priority to U.S. Provisional Patent Application No. 60/374,385 filed Apr. 19, 2002 entitled "METHOD AND APPARATUS FOR EMPLOYING FLAT RATE"; is a continuation-in-part U.S. patent application Ser. No. 09/518,760 filed Mar. 3, 2000 and issued on Jun. 20, 2000 as U.S. Pat. No. 6,319,127 entitled "GAMING DEVICE FOR A FLATE RATE PLAY SESSION AND A METHOD OF OPERATING SAME"; also claims priority to U.S. Provisional Patent Application No. 60/282,792 filed Apr. 10, 2001 entitled "GAMING CONTRACTS".

The present application relates to pending U.S. patent application Ser. No. 10/908,957 filed Jun. 2, 2005 entitled "METHOD AND APPARATUS FOR FACILITATING PLAY OF A GAMING DEVICE", which is a continuation-in-part of pending U.S. patent application Ser. No. 10/420,066 filed Apr. 21, 2003 entitled "METHOD AND APPARATUS FOR EMPLOYING FLAT RATE", which claims priority to U.S. Provisional Patent Application No. 60/374,385 filed Apr. 19, 2002 entitled "METHOD AND APPARATUS FOR EMPLOYING FLAT RATE"; also claims a benefit to U.S. Provisional Patent Application No. 60/581,557 filed Jun. 21, 2004 entitled "METHOD AND APPARATUS FOR FACILITATING PLAY OF A GAMING DEVICE"; and also claims a benefit to U.S. Provisional Patent Application No. 60/581,562 filed Jun. 21, 2004 entitled "METHOD AND APPARATUS FOR PACKAGE PLAY INTERFACE".

The present application relates to pending U.S. patent application Ser. No. 11/270,016 filed Nov. 9, 2005 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which claims a benefit to U.S. Provisional Patent Application No. 60/627,670 filed Nov. 12, 2004 entitled GAMING DEVICE OFFERING A FLAT RATE PLAY SESSION AND METHODS THEREOF"; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE".

The present application relates to abandoned U.S. patent application Ser. No. 11/428,605 filed Jul. 5, 2006 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which is a continuation of pending U.S. patent application Ser. No. 11/270,016 filed Nov. 9, 2005 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE"; and is also a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Jun. 20, 2000 entitled "GAMING DEVICE FOR A FLAT RATE PLAY SESSION AND A METHOD OF OPERATING SAME".

The present application relates to abandoned U.S. patent application Ser. No. 11/428,606 filed Jul. 5, 2006 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which is a continuation of pending U.S. patent application Ser. No. 11/270,016 filed Nov. 9, 2005 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE", and is also a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME".

The present application relates to pending U.S. patent application Ser. No. 11/254,352 filed Oct. 20, 2005 entitled "METHODS AND APPARATUS FOR FACILITATING A FLAT RATE PLAY SESSION AND FOR EXTENDING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME".

The present application relates to pending U.S. patent application Ser. No. 11/428,848 filed Jul. 6, 2006 entitled "METHODS AND APPARATUS FOR FACILITATING A FLAT RATE PLAY SESSION AND FOR EXTENDING SAME", which is a continuation of pending U.S. Patent application Ser. No. 11/254,352 filed Oct. 20, 2005 entitled "METHODS AND APPARATUS FOR FACILITATING A FLAT RATE PLAY SESSION AND FOR EXTENDING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001,entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME".

The present application relates to abandoned U.S. patent application Ser. No. 11/428,852 filed Jul. 6, 2006, which is a continuation of pending U.S. patent application Ser. No. 11/254,352 filed Oct. 20, 2005 entitled "METHODS AND APPARATUS FOR FACILITATING A FLAT RATE PLAY SESSION AND FOR EXTENDING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME".

The present application relates to pending U.S. patent application Ser. No. 11/266,875 filed Nov. 4, 2005 entitled "FLATE RATE PLAY CONTRACT PRICE ADJUSTMENTS", which claims priority to U.S. Provisional Patent Application No. 60/627,670 filed Nov. 12, 2004 entitled "GAMING DEVICE OFFERING A FLAT RATE PLAY SESSION AND METHODS THEREOF".

The present application relates to pending U.S. patent application Ser. No. 11/274,740 filed Nov. 14, 2005 entitled "PRODUCTS AND PROCESSES FOR PROVIDING A BENEFIT ACCORDING TO A PATTERN IN OUTCOMES", which claims priority to U.S. Provisional Patent Application No. 60/627,670 filed Nov. 12, 2004 entitled "GAMING DEVICE OFFERING A FLAT RATE PLAY SESSION AND METHODS THEREOF"; and also claims priority to U.S. Provisional Patent Application No. 60/637,338 filed Dec. 17, 2004 entitled "GAMING DEVICE OFFERING A FLAT RATE PLAY SESSION AND METHODS THEREOF"; and also claims priority to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE".

The present application relates to pending U.S. patent application Ser. No. 11/273,368 filed Nov. 14, 2005 entitled "METHOD AND APPARATUS FOR DISCOUNTING A FLAT RATE GAMING SESSION", which claims priority to U.S. Provisional Patent Application No. 60/627,670 filed Nov. 12, 2004 entitled "GAMING DEVICE OFFERING A FLAT RATE PLAY SESSION AND METHODS THEREOF"; and is a continuation-in-part of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME".

The present application relates to pending U.S. patent application Ser. No. 11/268,315 filed Nov. 7, 2005 entitled "METHOD AND APPARATUS FOR OFFERING A FLAT RATE GAMING SESSION WITH OPTIONAL GAME FEATURES", which claims priority to U.S. Provisional Patent Application No. 60/627,670 filed Nov. 12, 2004 entitled "GAMING DEVICE OFFERING A FLAT RATE PLAY SESSION AND METHODS THEREOF"; and claims priority to pending U.S. patent application Ser. No. 11/270,016 filed Nov. 9, 2005 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE".

The present application relates to abandoned U.S. patent application Ser. No. 11/273,170 filed Nov. 14, 2005 entitled "BUDGET-DEFINED FLAT RATE PLAY CONTRACT PARAMETERS", which claims priority to U.S. Provisional Patent Application No. 60/627,670 filed Nov. 12, 2004 entitled "GAMING DEVICE OFFERING A FLAT RATE PLAY SESSION AND METHODS THEREOF".

The present application relates to pending U.S. patent application Ser. No. 11/423,486 filed Jun. 12, 2006 entitled "BUDGET-DEFINED FLAT RATE PLAY CONTRACT PARAMETERS", which is a continuation of abandoned U.S. patent application Ser. No. 11/273,170 filed Nov. 14, 2005 entitled "BUDGET-DEFINED FLAT RATE PLAY CONTRACT PARAMETERS", which claims priority to U.S. Provisional Patent Application No. 60/627,670 filed Nov. 12, 2004 entitled "GAMING DEVICE OFFERING A FLAT RATE PLAY SESSION AND METHODS THEREOF".

The present application relates to pending U.S. patent application Ser. No. 11/423,488 filed Jun. 12, 2006 entitled "BUDGET-DEFINED FLAT RATE PLAY CONTRACT PARAMETERS", which is a continuation of abandoned U.S. patent application Ser. No. 11/273,170 filed Nov. 14, 2005 entitled "BUDGET-DEFINED FLAT RATE PLAY CONTRACT PARAMETERS", which claims priority to U.S. Provisional Patent Application No. 60/627,670 filed Nov. 12, 2004 entitled "GAMING DEVICE OFFERING A FLAT RATE PLAY SESSION AND METHODS THEREOF".

The present application relates to pending U.S. patent application Ser. No. 11/423,492 filed Jun. 12, 2006 entitled "BUDGET-DEFINED FLAT RATE PLAY CONTRACT PARAMETERS", which is a continuation of abandoned U.S. patent application Ser. No. 11/273,170 filed Nov. 14, 2005 entitled "BUDGET-DEFINED FLAT RATE PLAY CONTRACT PARAMETERS", which claims priority to U.S. Provisional Patent Application No. 60/627,670 filed Nov. 12, 2004 entitled "GAMING DEVICE OFFERING A FLAT RATE PLAY SESSION AND METHODS THEREOF".

The present application relates to pending U.S. patent application Ser. No. 11/273,534 filed Nov. 14, 2005 entitled "METHOD AND APPARATUS FOR OFFERING A FLAT RATE GAMING SESSION WITH TIME EXTENSION AWARDS", which claims priority to U.S. Provisional Patent Application No. 60/627,670 filed Nov. 12, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE"; and is a continuation-in-part to U.S. patent application Ser. No. 10/778,984 filed Feb. 13, 2004 entitled "SYSTEM AND METHOD ENABLING EXTENSION OF A TIME ELEMENT IN A GAME", which claims priority to U.S. Provisional Patent Application No. 60/447,350 filed Feb. 13, 2003 entitled system and method enabling extension of time benefits in wagering game".

The present application relates to pending U.S. patent application Ser. No. 11/274,586 filed Nov. 14, 2005 entitled "PRODUCTS AND PROCESSES FOR DETERMINING A BENEFIT BASED ON PATTERNS OF OUTCOMES", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE".

The present application relates to pending U.S. patent application Ser. No. 11/273,799 filed Nov. 14, 2005 entitled "PRODUCTS AND PROCESSES FOR DETERMINING A BENEFIT BASED ON OCCURRENCES OF AN OUTCOME", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE".

The present application relates to pending U.S. patent application Ser. No. 11/266,625 filed Nov. 3, 2005 entitled "METHODS AND APPARATUS FOR FACILITATING A FLAT RATE PLAY SESSION INCLUDING SURRENDER AND/OR SESSION STRATEGY FEATURES", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE".

The present application relates to pending U.S. patent application Ser. No. 11/273,510 filed Nov. 14, 2005 entitled "METHODS AND APPARATUS FOR FACILITATING ACCELERATED PLAY OF A FLAT RATE PLAY GAMING SESSION"

The present application relates to pending U.S. patent application Ser. No. 11/273,510 filed Nov. 14, 2005 entitled "METHODS AND APPARATUS FOR FACILITATING ACCELERATED PLAY OF A FLAT RATE PLAY GAMING SESSION", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and is a continuation-in-part to U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS"; and is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME"; and is a continuation-in-part to U.S. patent application Ser. No. 10/331,438 filed Dec. 27, 2002 entitled "METHOD AND APPARATUS FOR AUTOMATICALLY OPERATING A GAME MACHINE", which claims a priority to U.S. Provisional Patent Application No. 60/373,750 filed Apr. 18, 2002 entitled "METHOD AND APPARATUS FOR AUTOMATICALLY OPERATING A GAME MACHINE"; and also is a continuation-in-part of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE".

The present application relates to abandoned U.S. patent application Ser. No. 11/456,758 filed Jul. 11, 2006 entitled "METHODS AND APPARATUS FOR FACILITATING ACCELERATED PLAY OF A FLAT RATE PLAY GAMING SESSION", which is a continuation of pending U.S. patent application Ser. No. 11/273,510 filed Nov. 14, 2005 entitled "METHODS AND APPARATUS FOR FACILITATING ACCELERATED PLAY OF A FLAT RATE PLAY GAMING SESSION", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and is a continuation-in-part to U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS"; and is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME"; and is a continuation-in-part to U.S. patent application Ser. No. 10/331,438 filed Dec. 27, 2002 entitled "METHOD AND APPARATUS FOR AUTOMATICALLY OPERATING A GAME MACHINE", which claims a priority to U.S. Provisional Patent Application No. 60/373,750 filed Apr. 18, 2002 entitled "METHOD AND APPARATUS FOR AUTOMATICALLY OPERATING A GAME MACHINE"; and also is a continuation-in-part of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE".

The present application relates to pending U.S. patent application Ser. No. 11/273,093 filed Nov. 14, 2005 entitled "METHODS AND APPARATUS FOR REVIEWING GAME PLAY OF A FLAT RATE PLAY SESSION", which is a continuation-in-part to U.S. Provisional Patent Application No. 60/627,670 filed Nov. 12, 2004 entitled GAMING DEVICE OFFERING A FLAT RATE PLAY SESSION AND METHODS THEREOF"; and is a continuation-in-part to U.S. Provisional Patent Application No. 60/637,338 filed Dec. 17, 2004 entitled "GAMING DEVICE OFFERING A FLAT RATE PLAY SESSION AND METHODS THEREOF"; and is a continuation-in-part of pending U.S. patent application Ser. No. 10/636,520 filed Aug. 7, 2003 entitled "SYSTEM AND METHOD FOR COMMUNICATING GAME SESSION INFORMATION", which is a continuation-in-part of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME" and also U.S. patent application Ser. No. 10/159,722; and is also a continuation-in-part of U.S. patent application Ser. No. 10/635,986 filed Aug. 7, 2003 entitled "SYSTEM AND METHOD FOR REMOTE AUTOMATED PLAY OF GAMING DEVICES", which claims priority of U.S. Provisional Patent Application No. 60/401,853 filed Aug. 7, 2002 entitled "SYSTEM AND METHOD FOR REMOTE AUTOMATED PLAY OF GAMING DEVICES"; and also is a continuation-in-part of U.S. patent application Ser. No. 10/159,722 filed May 30, 2002, and issued as U.S. Pat. No. 6,969,317 on Nov. 29, 2005 entitled "SYSTEM AND METHOD FOR AUTOMATED PLAY OF MULTIPLE GAMING DEVICES", which is a continuation of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE"; and also is a continuation-in-part to U.S. patent application Ser. No. 10/331,438 filed Dec. 27, 2002 entitled "METHOD AND APPARATUS FOR AUTOMATICALLY OPERATING A GAME MACHINE", which claims a priority to U.S. Provisional Patent Application No. 60/373,750 filed Apr. 18, 2002 entitled "METHOD AND APPARATUS FOR AUTOMATICALLY OPERATING A GAME MACHINE"; and also is a continuation-in-part of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE".

The present application relates to abandoned U.S. patent application Ser. No. 11/456,726 filed Jul. 11, 2006 entitled "METHODS AND APPARATUS FOR REVIEWING GAME PLAY OF A FLAT RATE PLAY SESSION", which is a continuation of pending U.S. patent application Ser. No. 11/273,093 filed Nov. 14, 2005 entitled "METHODS AND APPARATUS FOR REVIEWING GAME PLAY OF A FLAT RATE PLAY SESSION", which is a continuation-in-part to U.S. Provisional Patent Application No. 60/627,670 filed Nov. 12, 2004 entitled GAMING DEVICE OFFERING A FLAT RATE PLAY SESSION AND METHODS THEREOF"; and is a continuation-in-part to U.S. Provisional Patent Application No. 60/637,338 filed Dec. 17, 2004 entitled "GAMING DEVICE OFFERING A FLAT RATE PLAY SESSION AND METHODS THEREOF"; and is a continuation-in-part of pending U.S. patent application Ser. No. 10/636,520 filed Aug. 7, 2003 entitled "SYSTEM AND METHOD FOR COMMUNICATING GAME SESSION INFORMATION", which is a continuation-in-part of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME" and also U.S. patent application Ser. No. 10/159,722; and is also a continuation-in-part of U.S. patent application Ser. No. 10/635,986 filed Aug. 7, 2003 entitled "SYSTEM AND METHOD FOR REMOTE AUTOMATED PLAY OF GAMING DEVICES", which claims priority of U.S. Provisional Patent Application No. 60/401,853 filed Aug. 7, 2002 entitled "SYSTEM AND METHOD FOR REMOTE AUTOMATED PLAY OF GAMING DEVICES"; and also is a continuation-in-part of U.S. patent application Ser. No. 10/159,722 filed May 30, 2002, and issued as U.S. Pat. No. 6,969,317 on Nov. 29, 2005 entitled "SYSTEM AND METHOD FOR AUTOMATED PLAY OF MULTIPLE GAMING DEVICES", which is a continuation of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent Application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE"; and also is a continuation-in-part to U.S. patent application Ser. No. 10/331,438 filed Dec. 27, 2002 entitled "METHOD AND APPARATUS FOR AUTOMATICALLY OPERATING A GAME MACHINE", which claims a priority to U.S. Provisional Patent Application No. 60/373,750 filed Apr. 18, 2002 entitled "METHOD AND APPARATUS FOR AUTOMATICALLY OPERATING A GAME MACHINE"; and also is a continuation-in-part of U.S. patent application Ser. No. 09/879,299 filed Jun. 12, 2001, and issued as U.S. Pat. No. 6,634,942 on Oct. 21, 2003 entitled "SYSTEM AND METHOD FOR AUTOMATED PLAY OF MULTIPLE GAMING DEVICES", which is a continuation-in-part of U.S. patent application Ser. No. 09/437,204 filed Nov. 9, 1999, and issued as U.S. Pat. No. 6,244,957 on Jun. 12, 2001 entitled "AUTOMATED PLAY GAMING DEVICE", which is a continuation of U.S. patent application Ser. No. 08/774,487 filed Dec. 30, 1996, and issued as U.S. Pat. No. 6,012,983 on Jan. 11, 2000 entitled "AUTOMATED PLAY GAMING DEVICE".

The present application relates to pending U.S. patent application Ser. No. 11/273,159 filed Nov. 14, 2005 entitled "METHODS AND APPARATUS FOR PAUSING A FLAT RATE PLAY GAMING SESSION", which claims a benefit to U.S. Provisional Patent Application No. 60/627,670 filed Nov. 12, 2004 entitled GAMING DEVICE OFFERING A FLAT RATE PLAY SESSION AND METHODS THEREOF; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE".

The present application relates to pending U.S. patent application Ser. No. 11/576,907 filed Apr. 9, 2007 entitled "FACILITATING A FLAT RATE PLAY SESSION WITH A PARALLEL GAME".

The present application relates to pending U.S. patent application Ser. No. 11/321,802 filed Dec. 29, 2005 entitled "SYSTEMS, METHODS AND APPARATUS FOR OFFERING AN EXTENSION OF A FLAT PLAY SESSION BASED ON AN ENDING CREDIT BALANCE", which is a continuation-in-part to pending U.S. patent application Ser. No. 11/270,016 filed Nov. 9, 2005 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which claims a benefit to U.S. Provisional Patent Application No. 60/627,670 filed Nov. 12, 2004 entitled GAMING DEVICE OFFERING A FLAT RATE PLAY SESSION AND METHODS THEREOF"; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE"; and is also a continuation-in-part of pending U.S. patent application Ser. No. 11/254,352 filed Oct. 20, 2005 entitled "METHODS AND APPARATUS FOR FACILITATING A FLAT RATE PLAY SESSION AND FOR EXTENDING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME".

The present application relates to abandoned U.S. patent application Ser. No. 11/456,750 filed Jul. 11, 2006 entitled "SYSTEMS, METHODS AND APPARATUS FOR OFFERING AN EXTENSION OF A FLAT PLAY SESSION BASED ON AN ENDING CREDIT BALANCE", which is a continuation of pending U.S. patent application Ser. No. 11/321,802 filed Dec. 29, 2005 entitled "SYSTEMS, METHODS AND APPARATUS FOR OFFERING AN EXTENSION OF A FLAT PLAY SESSION BASED ON AN ENDING CREDIT BALANCE", which is a continuation-in-part to pending U.S. patent application Ser. No. 11/270,016 filed Nov. 9, 2005 entitled "SYSTEMS, METHODS AND APPARATUS FOR FACILITATING A FLAT RATE PLAY SESSION ON A GAMING DEVICE AND EXAMPLE PLAYER INTERFACES TO A FACILITATE SUCH", which claims a benefit to U.S. Provisional Patent Application No. 60/627,670 filed Nov. 12, 2004 entitled GAMING DEVICE OFFERING A FLAT RATE PLAY SESSION AND METHODS THEREOF"; also claims a benefit to U.S. Provisional Patent Application No. 60/637,338 filed Dec. 17, 2004 entitled "GAMING DEVICE OFFERING A FLAT RATE PLAY SESSION AND METHODS THEREOF"; and claims a benefit to U.S. Provisional Patent Application No. 60/679,138 filed May 9, 2005 entitled "SYSTEMS, METHODS AND APPARATUS FOR FACILITATING A FLAT RATE PLAY SESSION ON A GAMING DEVICE"; and is also a continuation-in-part of pending U.S. patent application Ser. No. 11/254,352 filed Oct. 20, 2005 entitled "METHODS AND APPARATUS FOR FACILITATING A FLAT RATE PLAY SESSION AND FOR EXTENDING SAME", which is a continuation of U.S. patent application Ser. No. 10/001,089 filed Nov. 2, 2001, and issued as U.S. Pat. No. 7,140,964 on Nov. 28, 2006 entitled "GAMING DEVICE FOR A FLAT RATE PLAY SESSION AND A METHOD OF OPERATING SAME", which is a continuation-in-part of U.S. Provisional Application No. 60/282,792 filed Apr. 10, 2001, entitled "GAMING CONTRACTS", which is a continuation-in-part of U.S. patent application Ser. No. 09/518,760 filed Mar. 3, 2000, and issued as U.S. Pat. No. 6,319,127 on Nov. 20, 2001 entitled "GAMING DEVICE FOR A FLAT RATE PLAY SESSION AND A METHOD OF OPERATING SAME", which is a continuation of U.S. patent application Ser. No. 08/880,838 filed Jun. 23, 1997, and issued as U.S. Pat. No. 6,319,127 on Nov. 20, 2001 entitled "GAMING DEVICE FOR A FLAT RATE PLAY SESSION AND A METHOD OF OPERATING SAME".

The present application relates to U.S. Provisional Patent Application No. 60/820,298 filed Jul. 25, 2006 entitled "METHODS AND APPARATUS FOR FACILITATING GAMING SESSIONS VIA A SESSION TICKET"; and pending U.S. patent application Ser. No. 11/828,114 filed Jul. 25, 2007 entitled "METHODS AND APPARATUS FOR FACILITATING GAMING SESSIONS VIA A SESSION TICKET, which claims priority to U.S. Provisional Patent Application No. 60/865,273 filed Nov. 10, 2006 entitled "METHODS AND APPARATUS FOR FACILITATING GAMING SESSIONS VIA A SESSION TICKET".

The present application relates to (i) U.S. Provisional Patent Application No. 60/805,106 filed Jun. 19, 2006, (ii) U.S. Provisional Patent Application No. 60/865,234 filed Nov. 10, 2006; and (iii) U.S. Provisional Patent Application No. 60/895,693 filed Mar. 19, 2007.

Each of the above-listed applications is hereby incorporated by reference herein in its entirety

FIELD OF THE INVENTION

The present disclosure relates to applications involving gaming devices and more particularly to applications involving gaming devices in a networked environment.

DETAILED DESCRIPTION

Figure 1:
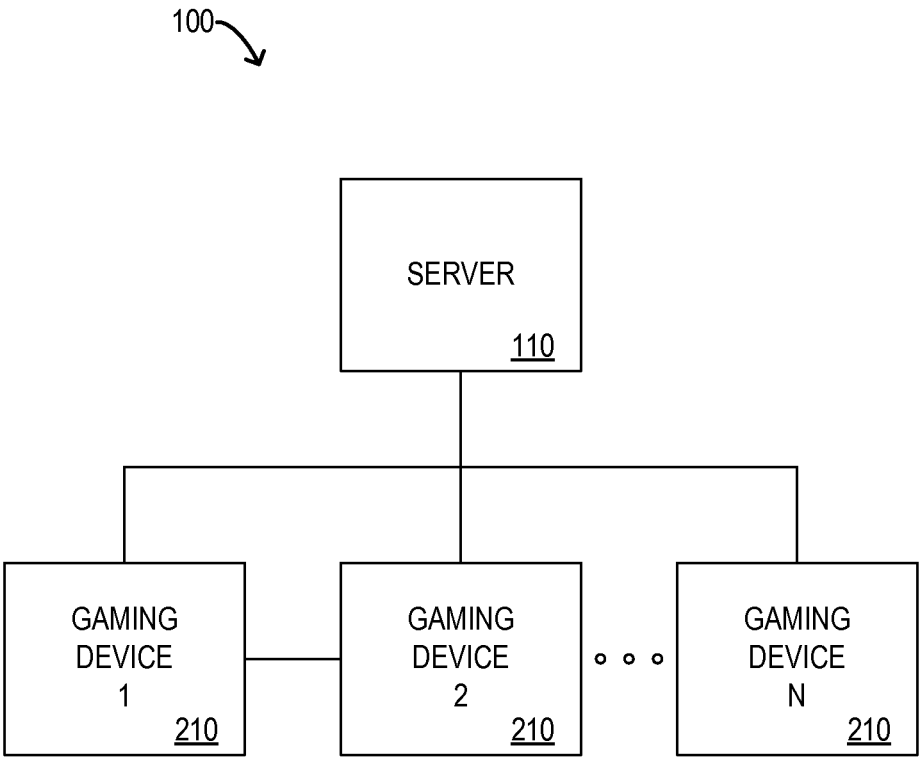
FIG. 1 is an illustration of an exemplary and non-limiting embodiment of a system for practicing one or more embodiments described herein.

There is described below in accordance with various exemplary and non-limiting embodiments a system 100 comprising a server 110 and at least one gaming device 210 in a networked environment In accordance with an exemplary and non-limiting embodiment, a method comprises receiving a request from a gaming device to initiate a session of game play comprising a plurality of game plays to be played, transmitting to the gaming device an amount of credit required to initiate a first game play of the session on the gaming device, and transmitting a session counter indicating a number of the plurality of games remaining in the session.

In accordance with another exemplary and non-limiting embodiment, a computer readable medium stores instructions configured to direct a processor to perform a method comprising receiving a request from a gaming device to initiate a session of game play comprising a plurality of game plays to be played, transmitting to the gaming device an amount of credit required to initiate a first game play of the session on the gaming device, and transmitting a session counter indicating a number of the plurality of games remaining in the session.

In accordance with another exemplary and non-limiting embodiment, an apparatus comprises a processor and a computer readable medium in communication with the processor and storing instructions configured to direct the processor to perform a method comprising receiving a request from a gaming device to initiate a session of game play comprising a plurality of game plays to be played, transmitting to the gaming device an amount of credit required to initiate a first game play of the session on the gaming device, and transmitting a session counter indicating a number of the plurality of games remaining in the session.

In accordance with an exemplary and non-limiting embodiment, a method comprises transmitting a request from a gaming device to initiate a session of game play comprising a plurality of game plays to be played, receiving at the gaming device an amount of credit required to initiate a first game play of the session on the gaming device, and receiving a session counter indicating a number of the plurality of games remaining in the session.

In accordance with another exemplary and non-limiting embodiment, a computer readable medium stores instructions configured to direct a processor to perform a method comprising transmitting a request from a gaming device to initiate a session of game play comprising a plurality of game plays to be played, receiving at the gaming device an amount of credit required to initiate a first game play of the session on the gaming device, and receiving a session counter indicating a number of the plurality of games remaining in the session.

In accordance with another exemplary and non-limiting embodiment, an apparatus comprises a processor and a computer readable medium in communication with the processor and storing instructions configured to direct the processor to perform a method comprising transmitting a request from a gaming device to initiate a session of game play comprising a plurality of game plays to be played, receiving at the gaming device an amount of credit required to initiate a first game play of the session on the gaming device, and receiving a session counter indicating a number of the plurality of games remaining in the session.

In accordance with an exemplary and non-limiting embodiment, a method comprises receiving a request from a gaming device to initiate a session of game play comprising a predetermined duration, transmitting to the gaming device an amount of credit required to initiate a first game play of the session on the gaming device, and transmitting a session timer indicating an amount of time remaining in the session.

In accordance with another exemplary and non-limiting embodiment, a computer readable medium stores instructions configured to direct a processor to perform a method comprising transmitting to the gaming device an amount of credit required to initiate a first game play of the session on the gaming device, and transmitting a session timer indicating an amount of time remaining in the session.

In accordance with another exemplary and non-limiting embodiment, an apparatus comprises a processor and a computer readable medium in communication with the processor and storing instructions configured to direct the processor to perform a method comprising transmitting to the gaming device an amount of credit required to initiate a first game play of the session on the gaming device, and transmitting a session timer indicating an amount of time remaining in the session.

In accordance with an exemplary and non-limiting embodiment, a method comprises transmitting a request from a gaming device to initiate a session of game play comprising a predetermined duration, receiving at the gaming device an amount of credit required to initiate a first game play of the session on the gaming device, and receiving a session timer indicating an amount of time remaining in the session.

In accordance with another exemplary and non-limiting embodiment, a computer readable medium stores instructions configured to direct a processor to perform a method comprising transmitting a request from a gaming device to initiate a session of game play comprising a predetermined duration, receiving at the gaming device an amount of credit required to initiate a first game play of the session on the gaming device, and receiving a session timer indicating an amount of time remaining in the session. In accordance with another exemplary and non-limiting embodiment, an apparatus comprises a processor and a computer readable medium in communication with the processor and storing instructions configured to direct the processor to perform a method comprising transmitting a request from a gaming device to initiate a session of game play comprising a predetermined duration, receiving at the gaming device an amount of credit required to initiate a first game play of the session on the gaming device, and receiving a session timer indicating an amount of time remaining in the session.

In accordance with an exemplary and non-limiting embodiment, a method comprises determining an amount of credit required to initiate a game play on a gaming device, thereby determining a first amount of credit, determining an amount of credit available for initiating game plays on the gaming device, thereby determining a second amount of credit, the second amount of credit being stored in a memory of the gaming device, if the second amount is less than the first amount, determining a third amount of credit necessary to make the second amount equal to the first amount, and transmitting the third amount of credit to the gaming device.

In accordance with another exemplary and non-limiting embodiment, a computer readable medium stores instructions configured to direct a processor to perform a method comprising determining an amount of credit required to initiate a game play on a gaming device, thereby determining a first amount of credit, determining an amount of credit available for initiating game plays on the gaming device, thereby determining a second amount of credit, the second amount of credit being stored in a memory of the gaming device, if the second amount is less than the first amount, determining a third amount of credit necessary to make the second amount equal to the first amount, and transmitting the third amount of credit to the gaming device.

In accordance with another exemplary and non-limiting embodiment, an apparatus comprises a processor and a computer readable medium in communication with the processor and storing instructions configured to direct the processor to perform a method comprising determining an amount of credit required to initiate a game play on a gaming device, thereby determining a first amount of credit, determining an amount of credit available for initiating game plays on the gaming device, thereby determining a second amount of credit, the second amount of credit being stored in a memory of the gaming device, if the second amount is less than the first amount, determining a third amount of credit necessary to make the second amount equal to the first amount, and transmitting the third amount of credit to the gaming device.

Numerous embodiments are described, and are presented for illustrative purposes only. The described embodiments are not intended to be limiting in any sense. These embodiments are described in sufficient detail to enable those skilled in the art to practice the invention, and it is to be understood that other embodiments may be utilized and that structural, logical, software, electrical and other changes may be made without departing from the scope of the invention. Accordingly, those skilled in the art will recognize that the invention may be practiced with various modifications and alterations. Although particular features may be described with reference to one or more particular embodiments or figures that form a part of the present disclosure, and in which are shown, by way of illustration, specific embodiments, it should be understood that such features are not limited to usage in the one or more particular embodiments or figures with reference to which they are described. The present disclosure is thus neither a literal description of all possible embodiments nor a listing of features that must be present in all embodiments.

The terms "an embodiment", "embodiment", "embodiments", "the embodiment", "the embodiments", "an exemplary embodiment", "some embodiments", "an example embodiment", "at least one embodiment", "one or more embodiments" and "one embodiment" mean "one or more (but not necessarily all) embodiments of the invention(s)" unless expressly specified otherwise. The terms "including", "comprising" and variations thereof mean "including but not limited to", unless expressly specified otherwise.

The term "consisting of" and variations thereof mean "including and limited to", unless expressly specified otherwise.

The enumerated listing of items does not imply that any or all of the items are mutually exclusive. The enumerated listing of items does not imply that any or all of the items are collectively exhaustive of anything, unless expressly specified otherwise. The enumerated listing of items does not imply that the items are ordered in any manner according to the order in which they are enumerated.

The term "comprising at least one of" followed by a listing of items does not imply that a component or subcomponent from each item in the list is required. Rather, it means that one or more of the items listed may comprise the item specified. For example, if it is said "wherein A comprises at least one of: a, b and c" it is meant that (i) A may comprise a, (ii) A may comprise b, (iii) A may comprise c, (iv) A may comprise a and b, (v) A may comprise a and c, (vi) A may comprise b and c, or (vii) A may comprise a, b and c.

The terms "a", "an" and "the" mean "one or more", unless expressly specified otherwise.

The term "based on" means "based at least on", unless expressly specified otherwise.

The methods described herein (regardless of whether they are referred to as methods, processes, algorithms, calculations, and the like) inherently include one or more steps. Therefore, all references to a "step" or "steps" of such a method have antecedent basis in the mere recitation of the term 'method' or a like term. Accordingly, any reference in a claim to a 'step' or 'steps' of a method is deemed to have sufficient antecedent basis.

Headings of sections provided in this document and the title are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required, or that each of the disclosed components must communicate with every other component. On the contrary, a variety of optional components are described to illustrate the wide variety of possible embodiments described herein.

Further, although process steps, method steps, algorithms or the like may be described in a sequential order, such processes, methods and algorithms may be configured to work in alternate orders. In other words, any sequence or order of steps that may be described in this document does not, in and of itself, indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

It will be readily apparent that the various methods and algorithms described herein may be implemented by, e.g., appropriately programmed general purpose computers and computing devices. Typically a processor (e.g., a microprocessor or controller device) will receive instructions from a memory or like storage device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments described herein need not include the device itself.

In the following exemplary and non-limiting embodiments, there are described various software applications for use in a networked gaming environment such as that illustrated with reference to FIG. 1. For example, a casino network may feature various electronic wagering devices and one or more server 110 computers in communication therewith. Such a network may be constructed or adapted in a manner that features various software applications aimed at enhancing player amusement and increasing operator profits. Software may promote products and services to players, allow players to play in new ways, and gather data that may benefit further promotions conducted by the house. The network of gaming devices 210 and one or more server 110 computers may enable players to interact with the software via common input mechanisms of the gaming devices 210 (e.g., buttons or touch-sensitive display screens) or other electronic devices (cellular phones or personal computers). In one exemplary embodiment, a "window" of a gaming device 210 display screen (e.g., a small display screen area that expands to present the player with text, graphics and selectable options, pushing gaming content to the side) may be configured to periodically or continually allow players to engage with such software applications.

Exemplary and non-limiting embodiments may be configured to work in a network environment including a computer (e.g., a casino server 110) that is in communication, via a communications network, with one or more devices, such as gaming devices 210 (e.g., slot machine 300, video poker machines), kiosks, casino personnel devices, merchant point-of-sale (POS) terminals, component devices (e.g., display screens), peripheral devices (e.g., card readers) and so on. The computer may communicate with the devices directly or indirectly, via a wired or wireless medium such as the Internet, LAN, WAN or Ethernet, Token Ring, or via any appropriate communications means or combination of communications means. Each of the devices may comprise computers, such as those based on the Intel® Pentium® processor 205, that are adapted to communicate with the computer. Any number and type of devices may be in communication with the computer. Communication between the devices and the computer, and among the devices, may be direct or indirect, such as over the Internet through a Web site maintained by computer on a remote server 110 or over an online data network including commercial online service providers, bulletin board systems and the like. In yet other embodiments, the devices may communicate with one another and/or the computer over RF, cable TV, satellite links and the like.

Some, but not all, possible communication networks that may comprise the network or be otherwise part of the system include: a local area network (LAN), a wide area network (WAN), the Internet, a telephone line, a cable line, a radio channel, an optical communications line, and a satellite communications link. A variety of communications protocols may be part of the system, including but not limited to: Ethernet (or IEEE 802.3), SAP, SAS™, SuperSAS™, ATP, Bluetooth™, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device 210 and various component devices and/or peripheral devices (e.g., printers, bill acceptors, etc.), (ii) the Best of Breed (BOB) standard, which may facilitate communication between a gaming device 210 and one or more server(s) 110 related to play of one or more gaming devices 210 (e.g., communication that assists in providing accounting, player tracking, content management, ticket-in/ticket-out and progressive jackpot functionality), and/or (iii) the System-to-System (S2S) standard, which may facilitate communication between game-related servers 110 and/or casino property management servers 110 (e.g., a hotel server 110 comprising one or more databases that store information about booking and reservations). Communication may be encrypted to ensure privacy and prevent fraud in any of a variety of ways well known in the art.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time. In one embodiment, a server 110 computer may not be necessary and/or preferred. For example, one or more embodiments may be practiced on a stand-alone gaming device 210 and/or a gaming device 210 in communication only with one or more other gaming devices 210. In such an embodiment, any functions described as performed by the computer or data described as stored on the computer may instead be performed by or stored on one or more gaming devices 210.

With regards to exemplary and non-limiting embodiments, a kiosk may be configured to execute or assist in the execution of various processes of exemplary embodiments. In some embodiments, a kiosk may comprise a processor and a memory as described. A kiosk may also comprise various input devices (e.g., a keypad, a keyboard, a mouse, buttons, a port that receives player tracking cards, an optical scanner for reading barcodes or other indicia, a CCD camera, etc.), output devices (e.g., a display screen, audio speakers, etc.), benefit output devices (e.g., a coin tray or printer for printing cashless gaming tickets), combinations thereof (e.g., a "ticket-in/ticket-out" device, a touch-sensitive display screen, etc.), communications ports, and so on. Thus, a kiosk may comprise many of the features and components of a gaming device 210, though the kiosk itself may not necessarily be configured to enable gambling activity as a primary function. A kiosk may communicate with any or all of (i) a central controller (e.g. server 110), (ii) a gaming device 210, (iii) an inventory/reservation system of a casino-maintained property (e.g., a hotel), (iv) casino personnel devices, (v) merchant POS terminals, and so on. A number of kiosks may be stationed within casino premises (e.g., at various locations on a slot floor). In various embodiments, kiosks may execute or assist in the execution of (i) determining and outputting a player status or other types of data described herein (e.g., a kiosk receives a player tracking card, and outputs a number of accumulated reward which a player may be entitled to redeem), (ii) outputting payments to players (e.g., upon receipt of cashless gaming tickets, player tracking cards, smart cards, etc.), and/or (iii) any other process described herein. Thus, such a device may be configured to read from and/or write to one or more databases as described. The memory of such a device may store a program for executing such processes.

In some embodiments, various casino employees may be equipped with or otherwise utilize one or more casino personnel devices, such as personal digital assistants (PDAs) or other computing devices (e.g., personal computer terminals). A casino personnel device may comprise various input devices (e.g., a keypad, a touch-sensitive display screen, a card reader, an infrared bar code scanner, etc.), various output devices (e.g., an LCD screen), a processor, a memory and/or a communications port, similar to those described herein with respect to other devices. In some embodiments, a casino personnel device may communicate with a gaming device 210, server 110, kiosk, peripheral device, and/or an inventory/reservation system of a casino-maintained property (e.g., a hotel). Thus, a casino personnel device may be configurable to, among other things, (i) read from and/or write to one or more databases as described, (ii) assist in payments made to players (e.g., a representative "scans" a cashless gaming receipt and determines a value associated with the receipt, and if the receipt is valid, provides payment equal to the value), and/or (iii) execute or assist in the execution of various other processes described herein. The memory of such a device may store a program for executing such processes.

In some embodiments, various merchants (e.g., shops, restaurants, etc.) may utilize point-of-sale (POS) computer terminals to facilitate various processes of one or more exemplary embodiments disclosed herein. For example, in some embodiments, a player may receive a cashless gaming ticket redeemable for an amount of currency. However, the ticket may alternately or additionally be redeemable for an amount of credit at a particular merchant location. Thus, in some embodiments, merchants may utilize POS terminals to redeem such vouchers. In some embodiments, such devices may be configured to read from and/or write to one or more databases as described herein. Such POS terminals may thus comprise various hardware and software described herein with respect to other devices, and may communicate with (i) a central slot server 110, (ii) a gaming device 210, (iii) an inventory/reservation system (e.g., a computer terminal at a theatre communicates with an inventory database to determine a number of unsold seats for a certain event), (iv) a kiosk, and so on.

In some embodiments, various component devices (e.g., any or all of the benefit output devices, output devices, input devices and/or input output devices described herein) may be embodied as peripheral devices. For example, such devices may not necessarily be components of a gaming device 210, though they may be configured in such a manner so as to communicate with one or more gaming device processors 205 or any other devices described herein. For example, a peripheral device such as a large display device may be associated with a plurality of gaming devices 210, and thus may not necessarily be considered a component of any one gaming device 210. Further, in some embodiments, certain peripheral devices such as card readers may be interchangeable between gaming devices 210, and thus may be considered a component of a first gaming device 210 while connected thereto, removed from the first gaming device 210, connected to a second gaming device 210, and so on. In other embodiments, various peripheral devices may never be considered a component of a particular gaming device 210. For example, in some embodiments, a peripheral device such as a USB-based portable memory 220 device may store (i) one or more databases described herein, and/or (ii) a program 270 for executing one or more process steps described herein. Such a peripheral device may then be utilized by casino personnel for upgrading/retrofitting existing gaming devices 210 as described herein.

In one or more embodiments, aspects, such as interactive marketing applications made available through a "window" of gaming device 210 display screen, may be practiced by replacing and/or augmenting one or more components (e.g., hardware and/or software components) of an existing gaming device 210 or server 110. Thus, one or more embodiments may be applied as a retrofit or upgrade to existing gaming devices 210 or servers 110 currently available for use within various casinos.

For example, a memory (e.g., computer chip) of the gaming device 210 or server 110 may be replaced or added, the replacement or additional memory 220 storing a program 270 for instructing the processor 205 of the gaming device 210 to operate in accordance with one or more exemplary embodiments disclosed herein. In another example, data output via the gaming device 210 or server 110 (e.g., graphical and/or textual data displayed on the gaming device 210) may be replaced or added, the replacement or additional data indicating to a player information relevant to one or more exemplary embodiments disclosed herein.

In a specific example, a gaming device 210 or server 110 may comprise various electronic components mounted to one or more printed circuit boards (PCBs). Such components may include various hardware described herein, such as a communications port and various controllers of peripheral devices (e.g., a display controller), as well as a memory for storing programming instructions (software) and a processor for carrying out such instructions. One form of memory 220 commonly found gaming devices 210 is electronically erasable programmable read-only memory 220 or erasable programmable read-only memory (EEPROM or EPROM). Thus, in one or more embodiments, an EEPROM storing software with instructions for carrying out aspects of exemplary embodiments disclosed herein (as well as instructions for carrying out other functions traditionally performed by the gaming device 210) may replace an EEPROM previously installed in a gaming device 210, such that the gaming device 210 may be configured to operate in accordance with various processes of exemplary embodiments disclosed herein.

For example, a "server-based application window module" may be made available for purchase to various casino operators. The module, which may comprise various hardware and software (e.g., an EEPROM storing software instructions), may be installed in an existing gaming device 210 or server 110, such that when the module is installed, players or operators may elect (i) to play or offer a game (or application) by the gaming device 210 that does not incorporate aspects of exemplary embodiments disclosed herein, or (ii) to play or offer a game (or application) by the gaming device 210 in a manner that utilizes aspects of exemplary embodiments disclosed herein. Thus, players who are familiar with the games and/or applications offered by various gaming devices 210 may elect to pay for them in a different or similar manner as they are accustomed to. For example, a player may choose to purchase a session of game plays, such as 200 spins at a slot machine.

Accordingly, a gaming device 210 may be configured to allow a player or operator to select one of two "modes" for one or more gaming devices 210, and to enable the selected mode. For example, if a player or operator selects a "standard" mode, a gaming device 210 may be configured to operate in a manner similar to how it operated before the installation of the module (e.g., the gaming device 210 operates in a conventional manner, such that aspects of the exemplary embodiments disclosed herein may not be utilized). If a player or operator activates a "session" mode, the gaming device 210 may then be operable to execute game play in accordance with one or more aspects of the exemplary embodiments disclosed herein. For example, in session mode, game play may commence on the gaming device 210 wherein the server 100 pushes credits to the gaming device 210 to facilitate game play until such time as the server 100 determined that the session has expired.

In one example of allowing a player to select one or more mode(s), a touch-sensitive display screen may be configured to output a prompt asking a player to select at least one mode of operation. Such a prompt may be output in response to one or more triggering conditions (e.g., coins, bills or tickets are inserted; a credit balance increases from zero to some other number; a player presses a "play" button; a motion, weight, infrared or other sensor detects the presence of a player; etc.). Accordingly, a player may select a mode of operation (e.g., by pressing an appropriately labeled icon of a touch-sensitive display screen), and upon receiving the player's selection, the gaming device 210 may be configured to operate in the selected mode.

In other embodiments, as described, a peripheral device may be useful for implementing one or more embodiments into the operation of a gaming device 210. For example, in order to avoid or minimize the necessity of modifying or replacing a program 270 already stored in a memory 220 of a gaming device 210, an external or internal module that comprises a peripheral device may be inserted in, connected to or otherwise associated with the gaming device 210.

In still further exemplary embodiments, rather than configure gaming devices to execute aspects of exemplary embodiments disclosed herein by installing or connecting new hardware and/or software, software may be downloaded into an existing memory 220 of one or more gaming devices 210. U.S. Pat. No. 6,805,634 to Wells et al. teaches methods for downloading data to gaming devices 210 in such a manner. The entirety of U.S. Pat. No. 6,805,634 is incorporated by reference herein for all purposes. Thus, in some embodiments, an existing gaming device 210 may be reprogrammed to accommodate new functionality of the exemplary embodiments disclosed herein without the need, or by minimizing the need, to remove and replace hardware within the gaming device 210.

Following are various exemplary and non-limiting embodiments of software applications that may reside on a gaming network 100 (e.g., within memory 220 of a gaming device 210 and/or server 110). Such applications may be configurable by both operators and players (e.g., a slot manager toggles software parameters using a server 110, a player selects various preferred options using an input device 240 associated with a gaming device 210).

Figure 2:
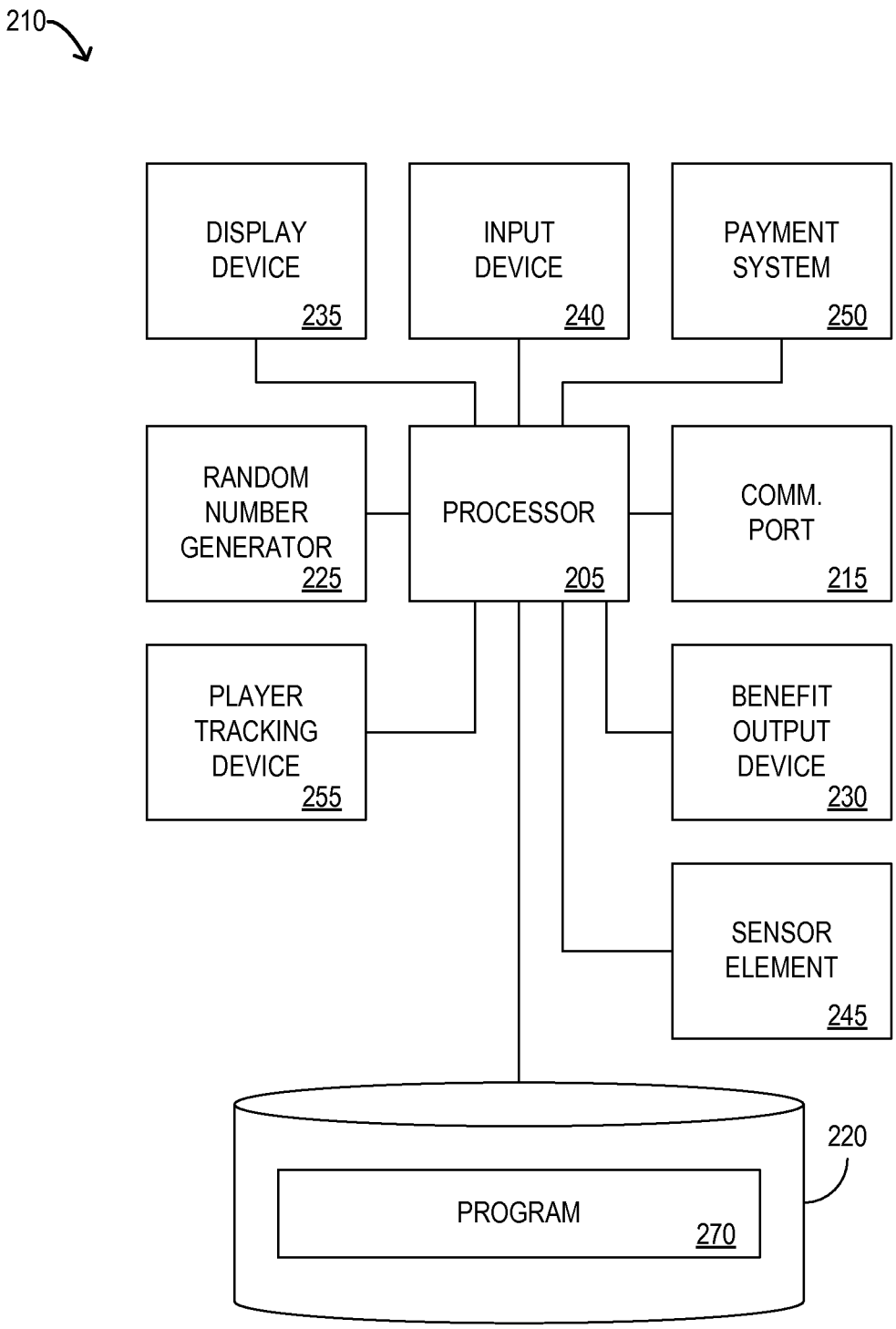
FIG. 2 is an illustration of an exemplary and non-limiting embodiment of a gaming device described herein.

With reference to FIG. 2, there is illustrated an exemplary and non-limiting embodiment of a gaming device 210. The gaming device 210 may be implemented as a system server 110, a dedicated hardware circuit, an appropriately programmed general-purpose computer, or any other equivalent electronic, mechanical or electro-mechanical device. The gaming device 210 may comprise, for example, a slot machine 300, a video poker machine, a video blackjack machine, a video keno machine, a video lottery machine, a pachinko machine or a table-top game. In various embodiments, a gaming device 210 may comprise, for example, a personal computer (e.g., which communicates with an online casino Web site), a telephone (e.g., to communicate with an automated sports book that provides gaming services), or a portable handheld gaming device (e.g., a device similar to a PDA). The gaming device 210 may comprise any or all of the gaming devices 210 of the aforementioned systems. In some embodiments, a user device such as a PDA or cell phone may be used in place of, or in addition to, some or all of the gaming device 210 components. For example, in some embodiments, a gaming device 210 may comprise a wireless handheld device similar to the WifiCasino GS offered by Diamond I Technologies of Baton Rouge, La. Further, a gaming device 210 may comprise a personal computer or other device, which may be operable to communicate with an online casino and facilitate game play at the online casino. In one or more embodiments, the gaming device 210 may comprise a computing device operable to execute software that simulates play of a reeled slot machine-type game, video poker game, video blackjack game, video keno game, video roulette game, or lottery game. In further embodiments, a gaming device 210 comprises a table game (e.g., a standard table game, a "smart" table with components for reading values from cards and/or chips, an electronic virtual table with simulated dealer/cards/chips, etc.).

In some embodiments (e.g., in an embodiment in which a server 110 manages downloadable games playable on one or more gaming devices 210), the memory 220 may store additional databases. Examples of such additional databases include, but are not limited to, (i) a gaming device database that stores information related to one or more gaming devices 210 with which the server is operable to communicate; (ii) a game database that stores information regarding one or more games playable on downloadable and/or currently active in association with one or more gaming devices 210; and (iii) a scheduling and/or configuration database useful for determining which games are to be made available on which gaming devices 210.

Similarly, in one embodiment a server 110 may be operable to configure a gaming device 210 remotely, update software stored on a gaming device 210 and/or to download software or software components to a gaming device 210. For example, a server 110 may be operable to apply a hot fix to software stored on a gaming device 210, modify a payout and/or probability table stored on a gaming device 210 and/or transmit a new version of software and/or a software component to a gaming device 210. A server 110 may be programmed to perform any or all of the above functions based on, for example, an occurrence of an event (e.g., a scheduled event), receiving an indication from a qualified casino employee and/or other person (e.g., a regulator) and/or receiving a request from a player. Alternately or additionally, in some embodiments, a "peer-to-peer" relationship between a first and second gaming device 210 may be utilized, such that a first gaming device 210 may store content in one or more databases which may be accessed by a second gaming device 210, a first gaming device 210 may remotely configure a second gaming device 210, and so on.

The gaming device 210 comprises a processor 205, such as one or more Intel® Pentium® processors. The processor 205 is operable to communicate with a random number generator 225, which may be a component of the gaming device 210. The random number generator 225, in accordance with at least one embodiment may generate data representing random or pseudo-random values (referred to as "random numbers" herein). The random number generator 225 may generate a random number, for example, every predetermined unit of time (e.g., every thousandth of a second) or in response to an initiation of a game on the gaming device 210. In the former embodiment, the generated random numbers may be used as they are generated (e.g., the random number generated at substantially the time of game initiation is used for that game) and/or stored for future use. A random number generated by the random number generator 225 may be used by the processor 205 to determine, for example, at least one of an outcome and payout. A random number generator 225, as used herein, may be embodied as a processor 205 separate from but working in cooperation with the processor 205. Alternatively, the random number generator 225 may be embodied as an algorithm, program 270 component, or software stored in the memory 220 of the gaming device 210 and used to generate a random number. Note that, although the generation or obtainment of a random number is described herein as involving a random number generator 225 of a gaming device 210, other methods of determining a random number may be employed. For example, a gaming device 210 owner or operator may obtain sets of random numbers that have been generated by another entity. HotBits™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof.

Of course, as would be understood by one of ordinary skill in the art, a random number generator 225 may be stored in a device other than a gaming device 210. For example, in some embodiments, a gaming device 210 may receive random numbers and/or any other data related to the random or pseudo-random determination of an outcome from a separate device, such as a server 110. It should be noted that such embodiments may be advantageous in environments or jurisdictions wherein the "central determination" of outcomes is required by regulation or otherwise preferred. Thus, for example, outcomes may be determined centrally by a server 110, and then propagated (e.g., electronically) such that indications of the outcomes may be viewed using one or more gaming devices 210 (e.g., "Class II" gaming devices 210, "thin-client"-oriented gaming devices 210 in a server-based "Class III" network architecture, Video Lottery Terminals, and so on).

The processor 205 may also be operable to communicate (e.g., via a protocol such as GDS) with various component devices associated with the gaming device 210, including but not limited to benefit output devices 230, output devices 235 (such as display devices), input devices 240 and/or input/output devices.

In some embodiments, a benefit output device 230 may be a component of gaming device 210. The benefit output device 230 may comprise one or more devices for outputting a benefit to a player of the gaming device 210. For example, in one embodiment the gaming device 210 may provide coins and/or tokens as a benefit. In such an embodiment the benefit output device 230 may comprise a hopper and hopper controller, for dispensing coins and/or tokens into a coin tray of the gaming device 210. In another example, the gaming device 210 may provide a receipt or other document on which there is printed an indication of one or more benefits (e.g., a cashless gaming ticket as is known in the art). In such an embodiment, the benefit output device 230 may comprise a printing and document dispensing mechanism. In yet another example, the gaming device 210 may provide electronic credits as a benefit (which, e.g., may be subsequently converted to coins and/or tokens and dispensed from a hopper into a coin tray). In such an embodiment, the benefit output device 230 may comprise a credit meter balance and/or a processor 205 that manages the amount of electronic credits that is indicated on a display of a credit meter balance. In yet another example, the gaming device 210 may credit a monetary amount to a financial account associated with a player as a benefit provided to a player. The financial account may be, for example, a credit card account, a debit account, a charge account, a checking account, or a casino account (e.g., an account from which the player may access cashable and/or non-cashable funds using a player tracking card or smart card). In such an embodiment the benefit output device 230 may comprise a device for communicating with a server 110 on which the account is maintained. Note that, in one or more embodiments, the gaming device 210 may include more than one benefit output device 230. For example, the gaming device 210 may include both a hopper and hopper controller combination and a credit meter balance. Such a gaming device 210 may be operable to provide more than one type of benefit to a player of the gaming device 210. A single benefit output device 230 may be operable to output more than one type of benefit. For example, a benefit output device 230 may be operable to increase the balance of credits in a credit meter and communicate with a remote device in order to increase the balance of a financial account associated with a player.

The processor 205 may also be in communication with one or more other output devices besides the display device, for outputting information (e.g., to a person or another device). Such other one or more output devices may also be components of a gaming device 210. Such other one or more output devices may comprise, for example, an audio speaker (e.g., for outputting an outcome or information related thereto, in addition to or in lieu of such information being output via a display device); headphones; an infra-red transmitter; a radio transmitter; an electric motor; a printer (e.g., such as for printing cashless gaming tickets); a dispenser for outputting pre-printed coupons, tickets or vouchers; an infra-red port (e.g., for communicating with a second gaming device 210 or a portable device of a player); one or more universal serial bus (USB) ports; a Braille computer monitor; and a coin or bill dispenser. For gaming devices 210, common output devices include a cathode ray tube (CRT) monitor on a video poker machine, a bell on a gaming device 210 (e.g., rings when a player wins), an LED display of a player's credit balance on a gaming device 210, an LCD display of a personal digital assistant (PDA) for displaying keno numbers.

The processor 205 may also be in communication with one or more input devices, which may be capable of receiving an input (e.g., from a player or another device) and which may be a component of gaming device 210. Alternately or additionally, an input device may communicate with or be part of another device (e.g., a server 110, a gaming device 210, etc.). Some examples of input devices include: a bar-code scanner, an optical scanner configured to read other indicia of a voucher or cashless gaming ticket, a CCD camera, a magnetic stripe reader (e.g., for reading data encoded upon a player tracking card), a smart card reader (e.g., for reading data stored upon a smart card), a computer keyboard or keypad, a button, a handle 320, a lever, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from a second gaming device 210 or from a another device such as a smart card or PDA of a player), and a weight scale. For gaming devices 210, common input devices include a button or touch screen on a video poker machine, a lever or handle 320 connected to the gaming device 210, a magnetic stripe reader to read a player tracking card inserted into a gaming device 210, a touch screen for input of player selections during game play, and a coin and bill acceptor.

The processor 205 may also be in communication with a payment system 250, which may be a component of the gaming device 210. The payment system 250 is a device capable of accepting payment from a player (e.g., a bet or initiation of a balance) and/or providing payment to a player (e.g., a payout). Payment is not limited to money, but may also include other types of consideration, including products, services, and alternate currencies. Exemplary methods of accepting payment by the payment system 250 include (i) receiving hard currency (i.e. coins or bills), and accordingly the payment system 250 may comprise a coin or bill acceptor; (ii) receiving an alternate currency (e.g., a paper cashless gaming ticket, an electronic credit, a coupon, a non-negotiable token), and accordingly the payment system 250 may comprise a bar code reader or other sensing means; (iii) receiving a payment identifier (e.g., a credit card number, a debit card number, a player tracking card number, a financial account identifier) and debiting the account identified by the payment identifier; and (iv) determining that a player has performed a value-added activity (e.g., participating in surveys, monitoring remote images for security purposes, referring friends to the casino).

In some embodiments, a gaming device 210 may comprise components capable of facilitating both input and output functions (i.e., input/output devices). In one example, a touch-sensitive display screen comprises an input/output device (e.g., the device outputs graphics and receives selections from players). In some embodiments, a touch-sensitive display screen may comprise force-feedback technology for outputting physical stimulus to players (Immersion TouchSense®, an example of such technology, is manufactured by Immersion Corporation of San Jose, Calif.). In another example, a processor 205 may communicate with a "ticket-in/ticket-out" device configured to dispense and receive cashless gaming tickets as is known in the art. Such a device may also assist in (e.g., provide data so as to facilitate) various accounting functions (e.g., ticket validation and redemption). For example, any or all of a gaming device 210, kiosk and casino personnel device maintained at a cashier cage may (i) comprise such a benefit input/output device, and/or (ii) communicate with a central server 110 that manages the accounting associated with such ticket-in/ticket-out transactions (e.g., so as to track the issuance, redemption and expiration of such vouchers). One example of such ticket-in/ticket-out technology, the EZ Pay™ system, is manufactured by International Gaming Technology, headquartered in Reno, Nev.

It should be appreciated that one or more embodiments may include storing graphic and/or sound elements that are used to construct a menu of options available for a player's selection via a touch screen. These elements may be stored, for example, in EEPROM, flash memory 220, hard disk, CD-ROM, or in any other suitable storage device. The menu may be displayed via any suitable display device, such as a CRT, LCD, VFC, LED display. In one embodiment, the menu may be implemented using only dedicated electromechanical switches. In one embodiment, a player operates an input device 240 of the gaming device 210 to cause such a menu to be displayed. In one embodiment, a gaming device 210 includes a touch screen and a touch screen controller (not shown) associated with a video monitor display device 235. The touch screen and touch screen controller may be operable to communicate with a video controller of the video monitor display device and a processor 205 (e.g., processor 205 of gaming device 210). Thus, a player may be enabled to indicate decisions by touching the touch screen in the appropriate places.

In some embodiments, display of the menu of player options may preempt display of other information. For example, in one embodiment the same display device or screen used to display game play elements (e.g., video reels of a slot machine 300) during active game play may be used to provide a menu of available options. In another embodiment, a dedicated display device or screen may be used to display a menu of available options on a continuous, periodic, or other basis.

Of course, as would be understood by one of ordinary skill in the art, a gaming device 210 may comprise various combinations of such component devices. For example, in one or more embodiments, the gaming device 210 may include more than one display device, one or more other output devices, several input devices, and so on (e.g., two display screens, two audio speakers, a ticket-in/ticket-out device and several buttons).

The processor 205 may also communicate with a memory 220 and a communications port 215 (e.g., so as to communicate with one or more other devices). The memory 220 may comprise an appropriate combination of magnetic, optical and/or semiconductor memory 220, and may include, for example, Random Access Memory (RAM), Read-Only Memory (ROM), a compact disc and/or a hard disk. The memory 220 may comprise or include any type of computer-readable medium. The processor 205 and the memory 220 may each be, for example: (i) located entirely within a single computer or other device; or (ii) connected to each other by a remote communication medium, such as a serial port cable, telephone line or radio frequency transceiver. In one embodiment, the gaming device 210 may comprise one or more devices that are connected to a remote server 110 computer for maintaining databases.

The memory 220 stores a program 270 for controlling the processor 205. The processor 205 performs instructions of the program 270, and thereby operates in accordance with exemplary embodiments disclosed herein, and particularly in accordance with exemplary embodiments described in detail herein. The program 270 may be stored in a compressed, uncompiled and/or encrypted format. The program 270 furthermore includes program elements that may be necessary, such as an operating system, a database management system and "device drivers" for allowing the processor 205 to interface with computer peripheral devices. Appropriate program elements are known to those skilled in the art, and need not be described in detail herein.

The term "computer-readable medium" as used herein refers to any medium that participates in providing instructions to the processor 205 of the gaming device 210 (or any other processor of a device described herein) for execution. Such a medium may take many forms, including but not limited to, non-volatile media, volatile media, and transmission media. Non-volatile media include, for example, optical or magnetic disks, such as memory. Volatile media include dynamic random access memory (DRAM), which typically constitutes the main memory. Transmission media include coaxial cables, copper wire and fiber optics, including the wires that comprise a system bus coupled to the processor. Transmission media may carry acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM or EEPROM (electronically erasable programmable read-only memory), a FLASH-EEPROM, any other memory chip or cartridge, or any other medium from which a computer can read.

Various forms of computer readable media may be involved in carrying one or more sequences of one or more instructions to the processor 205 (or any other processor of a device described herein) for execution. For example, the instructions may initially be borne on a magnetic disk of a remote computer. The remote computer can load the instructions into its dynamic memory and send the instructions over a telephone line using a modem. A modem local to a gaming device 210 (or, e.g., a server 110) can receive the data on the telephone line and use an infrared transmitter to convert the data to an infrared signal. An infrared detector can receive the data carried in the infrared signal and place the data on a system bus for the processor 205. The system bus carries the data to main memory, from which the processor 205 retrieves and executes the instructions. The instructions received by main memory may optionally be stored in memory 220 either before or after execution by the processor 205.

According to an exemplary embodiment, the instructions of the program 270 may be read into memory 220 from another computer-readable medium, such as from a ROM. Execution of sequences of the instructions in program 270 causes processor 205 perform the process steps described herein. In alternate embodiments, hard-wired circuitry may be used in place of, or in combination with, software instructions for implementation of the processes of the embodiments disclosed herein. Thus, exemplary embodiments are not limited to any specific combination of hardware and software. As discussed with respect to aforementioned systems, execution of sequences of the instructions in a program 270 of a peripheral device in communication with the gaming device 210 may also cause the processor 205 to perform some of the process steps described herein.

The memory 220 may store one or more databases described herein. Some or all of the data stored in each database is also described. The described entries of the databases represent exemplary information only; those skilled in the art will understand that the number and content of the entries can be different from those illustrated herein. Further, despite any description of the databases as tables, an object-based model could be used to store and manipulate the data types and likewise, object methods or behaviors can be used to implement the processes of exemplary embodiments disclosed herein.

Where appropriate, a prior art probability database may be utilized in the performance of the inventive processes described herein. A probability database may be stored in the data storage device in tabular form, or any other appropriate database form, as is well known in the art. The data stored therein may include a number of exemplary records or entries, each defining a random number. Those skilled in the art will understand that the probability database may include any number of entries. The tabular representation may also define fields for each of the entries or records. The fields may specify: (i) a random number (or range of random numbers) that may be generated by the random number generator 225; and (ii) an outcome that indicates the one or more indicia comprising the outcome that corresponds to the random number of a particular record. A gaming device 210 may utilize a probability database to determine, for example, what outcome corresponds to a random number generated by a random number generator 225 and to display the determined outcome. The outcomes may comprise the three symbols to be displayed along the payline 315 of a three-reel slot machine 300. Other arrangements of probability databases are possible. For example, the book "Winning At Slot machines" by Jim Regan (Carol Publishing Group Edition, 1997) illustrates examples of payout and probability tables and how they may be derived. The entirety of this book is incorporated by reference herein for all purposes.

Further, where appropriate, a prior art payout database may be utilized in the performance of the inventive processes described herein. A payout database may be stored in the data storage device in tabular form, or any other appropriate database form, as is well known in the art. The data stored therein includes a number of example records or entries, each defining an outcome that may be obtained on a gaming device 210 that corresponds to a payout. Those skilled in the art will understand that the payout database may include any number of entries. The tabular representation also defines fields for each of the entries or records. The fields specify: (i) an outcome, which indicates the one or more indicia comprising a given outcome; and (ii) a payout that corresponds to each respective outcome. The outcomes may be those obtained on a three-reel slot machine 300.

A gaming device 210 may utilize the payout database to determine whether a payout should be output to a player as a result of an outcome obtained for a game. For example, after determining the outcome to output on the gaming device 210, the gaming device 210 may access the payout database to determine whether the outcome for output is one of the outcomes stored as corresponding to a payout. If it is, the gaming device 210 may provide the corresponding payout to the player.

Other arrangements of payout databases are possible.

Additionally, where appropriate, a player database may be utilized to store historical data associated with specific players. A player database may be used, for example, to store player wager data so that players wagering over a given threshold in a given amount of time may be rewarded for their patronage. The player database may also contain other information that may be useful in, for example, promoting and managing player behaviors (e.g., information about the player's gaming preferences, gaming sessions, outstanding debts, lodging arrangements, and the like). Further, the player database may store data regarding a given player's standing in a game session or bonus game, so that the player can continue the game session or bonus game at a plurality of game machines that have common access to the player database. Such player data may be stored in a relational database and retrieved or otherwise accessed by the processor 205 after receiving a "key" data point from the player, such as a unique identifier read from the player's player tracking card via a player tracking device 255 or cashless gaming ticket, PIN or code entered by a player using an input device of a gaming device 210, and so on.

Note that, although these databases may be described as being stored in a gaming device 210, in other embodiments some or all of these databases may be partially or wholly stored in another device, such as one or more of the peripheral devices, a peripheral device server, central server (e.g. server 110), kiosks, casino personnel devices, merchant POS terminals, and so on. Further, some or all of the data described as being stored in the databases may be partially or wholly stored (in addition to or in lieu of being stored in the memory 220 of the gaming device 210) in a memory of one or more other devices, such as one or more of the peripheral devices, another gaming device 210, a peripheral device server and/or the server 110.

In one embodiment, gaming device 210 may be operable to facilitate downloadable games such that games available for play on gaming device 210 may be stored on a server device (e.g., a server 110 or another dedicated device) and downloaded to the gaming device 210. In one embodiment, software components of the gaming device 210 may be remotely modified and/or updated by another device (e.g., a server 110 and/or another device). For example, a payout or probability table stored in the memory 220 of gaming device 210 may be altered, modified or updated remotely, hot fixes may be applied to software stored by the gaming device 210 and/or new versions of software may be downloaded to the gaming device 210. Similarly, the gaming device 210 may be programmed to retrieve any or all such updates from another device, as appropriate and preferred. Any of the above (e.g., downloading of a game, updating of software, modification of a payout or probability table) may occur, for example, based upon an occurrence of an event (e.g., a scheduled event), an indication being received from qualified casino personnel or other party (e.g., a regulator), and/or upon a request from a player. In one embodiment, a gaming device 210 may comprise a thin client device controlled be a server device (e.g., a server 110 or another dedicated device such as a peripheral device server).

A gaming device 210 may comprise a player tracking device 255 for reading data from player tracking cards and/or smart cards, such that (i) players may be identified, and (ii) various data associated with players may then be determined (e.g., a number of cashable credits; a number of promotional credits that may not be redeemed for cash; a number of accumulated loyalty points; a number of accumulated game elements such as symbols, cards or hands; etc.). In one example, a card reader device may determine an identifier associated with a player (e.g., by reading a player tracking card comprising an encoded version of the identifier), such that the gaming device 210 may then access data (e.g., of a player database, as described) associated with the player. In another example, a smart card reader device may determine data associated with a player directly by accessing a memory of an inserted smart card.

Thus, as known in the art, "smart cards" may incorporate (i) a memory, and (ii) means for accessing such a memory. For example, in one embodiment, the memory may store data related to aspects of the disclosed exemplary embodiments. In one embodiment, data may be written to the smart card as a player plays one or more gaming devices (e.g., such that various data may be updated on a continuous, periodic or event-triggered bases). Accordingly, in one or more embodiments one or more devices operable to carry out various processes (e.g., a gaming device 210 or kiosk) may have associated therewith a smart card reader device, such that data may be read from the smart card pursuant to the execution of such processes. An example of a smart card system that may be used to implement one or more embodiments is the s-Choice™ Smart Card Casino Management System from Smart Card Integrators, Inc.™.

Further, as known in the art, a gaming device 210 may comprise a player tracking module comprising (i) a card reader (e.g., a port into which player tracking cards may be inserted), (ii) various input devices (e.g., a keypad, a touch-screen), (iii) various output devices (e.g., a small, full-color display screen), and/or (iv) combinations thereof (e.g., a touch-sensitive display screen that accommodates both input and output functions). Various commercially available devices may be suitable for such an application, such as the NextGen™ interactive player tracking panel manufactured by IGT or the iVIEW display screen manufactured by Bally® Gaming and Systems.

Of course, other non-card-based methods of identifying players are contemplated. For example, a unique identification code may be associated with the player. The player may then be identified upon providing the code. For example, the code may be stored (e.g., within a database maintained within the gaming device 210 and/or a server 110) such that the player may enter the code using an input device of a gaming device 210, and accordingly be identified. In other embodiments, player biometrics may serve as identification means (e.g., a player is identified via a thumbprint or retinal scan). In further embodiments, a barcode of a cashless gaming ticket may encode a player identifier.

Thus, as described, various data associated with a player may be tracked and stored (e.g., in an appropriate record of a centrally-maintained database), such that it may be accessed as desired (e.g., when determining promotional offers or rewards to be provided to players, when determining the status of player with respect to a particular game or period of gambling activity, and so on). Further, various statistics may be measured in association with a player (e.g., coin-in statistics, win/loss statistics) and similarly accessed.

Various systems for facilitating such monitoring are contemplated. For example, a two-wire system such as one offered by International Gaming Systems (IGT) may be used. Similarly, a protocol such as the IGT SAS™ or SuperSAS™ protocol may be used. The SAS™ and SuperSAS™ protocols allow for communication between gaming machines and slot accounting systems and provide a secure method of communicating all necessary data supplied by the gaming device 210 to the online monitoring system. One aspect of the SAS™ and SuperSAS™ protocols that may be beneficial in implementing aspects of exemplary embodiments are the authentication function which allow operators and regulators to remotely interrogate gaming devices 210 for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that continually monitors gaming devices and corresponding customer/player gaming activity. Thus, for example, any one of these systems may be used to monitor a player's gaming activity in order to determine player outcomes, coin-in statistics, win/loss statistics and/or any other data deemed relevant.

Figure 3:
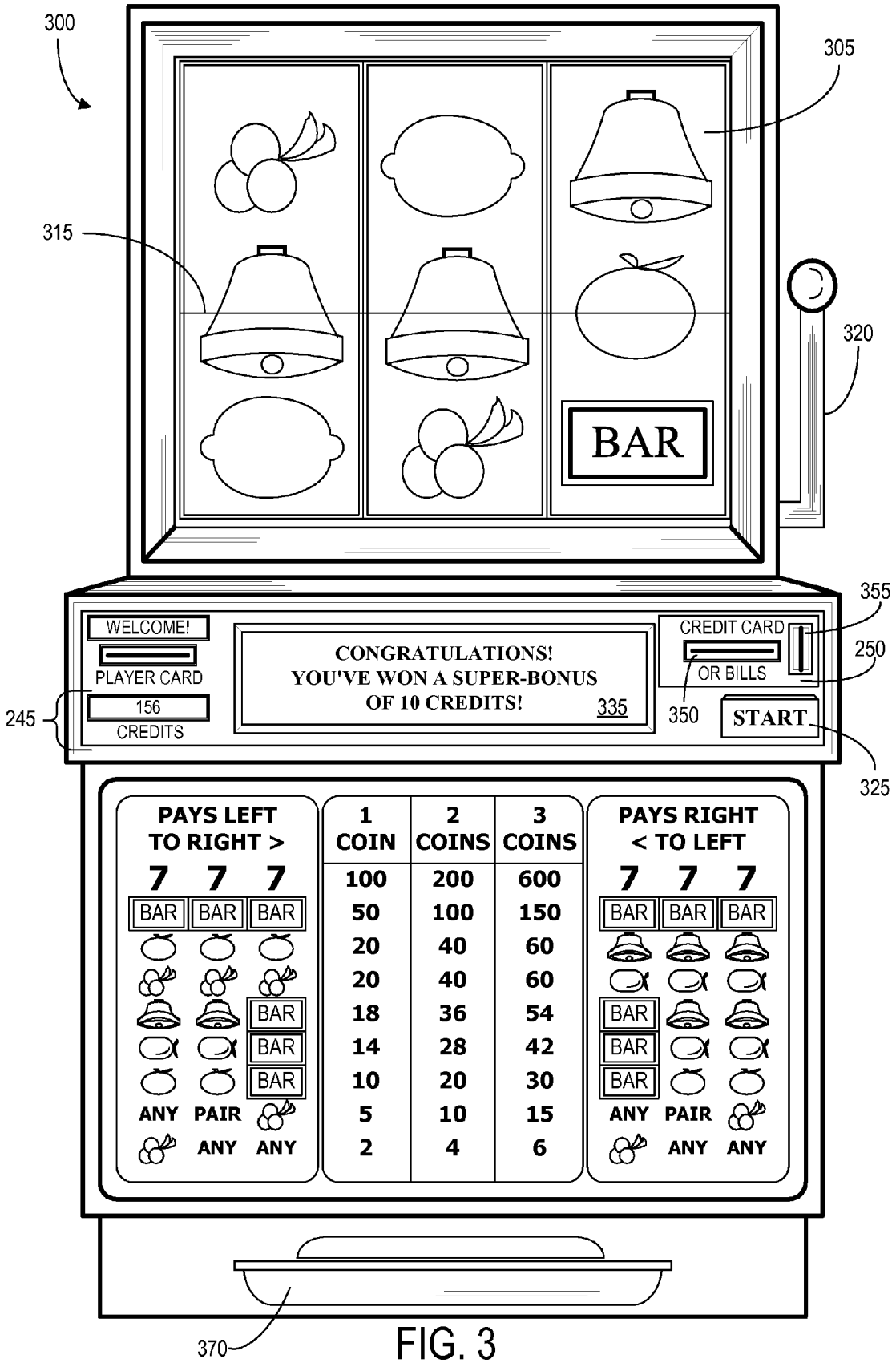
FIG. 3 is an illustration of an exemplary and non-limiting embodiment of a slot machine described herein.

As discussed herein, in one or more exemplary and non-limiting embodiments the gaming device 210 may take the form of a slot machine 300. A more specific description of a slot machine 300 suitable for use with the described exemplary embodiments follows with reference to FIG. 3.

A slot machine 300 for use in various exemplary embodiments may comprise, for example, a three-reel or five-reel slot machine 300. The slot machine 300 comprises a display area 305 in which an outcome for a game of the slot machine 300 is displayed to the player. The display area 305 may, for example, be a video display that displays graphical representations of reels. The display area 305 may, in another example, be glass behind which are located mechanical reels. Within the display area 305 is at least one payline 315. In accordance with one or more embodiments, an outcome of a game is a set of symbols displayed along a payline 315 of a reeled slot machine 300. The slot machine 300 may further comprise a handle 320. A player may initiate the movement of the reels in the display area 305 by pulling on the handle 320. Alternatively, a player may initiate the movement of the reels in the display area 305 by actuating a start button 325 or "spin" button (such a button may alternately be labeled "daub" in a Class II gaming environment or "enroll" in an environment where outcomes are requested from and determined by a device other than the gaming device 210). Either or both of the handle 320 and start button 325 are exemplary embodiments of an input device, as described herein.

The processor 205 may also be operable to communicate with various output devices. In some embodiments, an output device comprises a display device. The display device may comprise, for example, one or more display screens or areas for outputting information related to game play on the gaming device 210, such as a cathode ray tube (CRT) monitor, liquid crystal display (LCD) screen, or light emitting diode (LED) screen. In one or more embodiments, a gaming device 210 may comprise more than one display device. For example, a gaming device 210 may comprise an LCD display for displaying electronic reels and a display area 305 that displays rotating mechanical reels. The display device may comprise, for example, one or more display areas 305. For example, one of the display areas 305 (e.g., a primary game screen) may display outcomes of games played on the gaming device 210 (e.g., electronic reels of a gaming device 210). Another of the display areas 305 (e.g., a secondary game screen) may display rules for playing a game of the gaming device 210. Yet another of the display area 305 may display the benefits obtainable by playing a game of the gaming device 210 (e.g., in the form of a payout table). In one embodiment, a display area 305 may be used to present interactive software applications described herein. For example, a "window" may appear on a touch-sensitive gaming screen, presenting text, graphics and selectable options. The "window" may originate from a side of a display area 305, take up a portion of a screen, and push gaming content to the side (at least temporarily). Other arrangements of presenting interactive software through display areas 305 are contemplated (e.g., "pop-up" windows, small or large secondary screens, and the like). Software stored on a slot server 110 may intelligently determine triggers for opening and closing the window (e.g., player behaviors, time/date, inventory/capacity data, game history and/or operator influence may trigger the window's opening and/or closing), and players may be able to "call up" the window at their will.

In exemplary and non-limiting embodiments, action by a player, such as a handle pull, may trigger a determination, such as by the server 110, to push credits to the gaming device 210. For example, upon pulling the handle, the server 110 may determine that an additional amount of credits is required by the gaming device 210 in order to initiate game play. As a result, the server may push an amount of credits required to initiate or otherwise sustain game play to the gaming device 210.

Where appropriate, the slot machine 300 may also include an alternate, secondary game screen 335, for outputting information (e.g., payout information, outcome information, etc.) to a player. The secondary game screen may be utilized, for example, to inform a player of the player's standing in a game. The slot machine 300 may be capable of altering display and audio content as described herein (e.g., superimposing graphics over digital displays; a mask layer between physical reels and a player that shades or otherwise alters their appearance). In exemplary and non-limiting embodiments discussed more fully below, the secondary game screen 335 may be used to inform a player that credits are being pushed, such as from the server 110 to the gaming device 210. In another exemplary embodiment, there may be displayed a running count of the number of credits that have been pushed, such as in a session comprising a plurality of game plays or a predetermined duration of game play.

The slot machine 300 may also include a payment system 250, which is comprised of a bill acceptor 350, a credit card reader, a coin acceptor 355, and/or a ticket-in/ticket-out device. A player may utilize the payment system 250 to provide a wager for playing a game and/or for providing payment for provision of an outcome. In exemplary and non-limiting embodiments discussed more fully below, players may utilize the payment system 250 to purchase a session of game play. As used herein, a "session" refers to a number of game plays or game plays which are to be played during a duration of time, the number being greater than one. One example is a session comprised of 20 hands of video poker. Another example is a session comprising unlimited game plays played over a period of one hour.

The slot machine 300 may further comprise a credit meter balance 345, which is an exemplary embodiment of a benefit output device 230 described herein. The credit meter balance 345 reflects the amount of electronic credits currently available to a player. The electronic credits may be used by a player, for example, as wagers for games played on the gaming device 210. The electronic credits may also be "cashed out" as coins, bills, tokens, a cashout ticket, a cashout strip, and/or electronic credits to another financial account associated with the player.

As described more fully below in accordance with exemplary and non-limiting embodiments, adjustments to the credit meter balance 345 may occur in a manner that differs from the conventional use of a credit meter. With a conventional credit meter, credits are usually deducted each time a player actuates game play in an amount equal to that which is required to play the game. In the event that there are insufficient credits remaining to actuate game play, game play is halted until such time as the credit meter balance 345 is increased, such as by providing additional payment.

In accordance with exemplary embodiments, the credit meter balance may be adjusted based not only on the monetary inputs from the player, actions by the player and results of player game play, but also based upon credits pushed to the gaming device 210 from the server 110. In some exemplary embodiments, game play at the gaming device 210 is monitored, as by the server 110, to determine if credits need to be pushed to the gaming device 210, such as on a game-play-by-game-play basis.

Finally, the slot machine 300 may comprise a coin tray 370. Payment to the player may be rendered by dispensing coins into the coin tray. Such coins may be dispensed based on, for example, a player's indication that the player would like to cash out his credit meter balance and/or a payout obtained by a player as a result of playing a game on the slot machine 300. The coin tray is an exemplary embodiment of the benefit output device 230, described herein. Note that, where appropriate, the slot machine 300 may include different and/or additional components besides those discussed in this section.

In an exemplary and non-limiting embodiment, a virtual session is enabled on at least one gaming device 210. As used herein, a "virtual session" refers to a session comprised of one or more game plays that is monitored and enabled, either in part or in whole, by an entity separate from the gaming device 210 upon which the session appears to take place whereby an amount of credits necessary to facilitate ongoing game play are pushed by the separate entity to the gaming device 210 as needed. As a result, the gaming device 210 upon which the game plays take place needn't be substantially altered in order to provide virtual session play. For example, a server 110 may monitor a virtual session on a gaming device 210 and push credits when necessary to enable the virtual session thus obviating any action by a player to replenish or otherwise add credits to the gaming device 210. In this manner, an existing gaming device that has not previously been configured to enable session play may provide a player with the perception that a session is being played at the gaming device 210 when, in fact, it is a virtual session that is enabled by an entity remote from and in communication with the gaming device 210.

In one exemplary embodiment, a variation of session play (players buy a package of hands/spins for a flat, upfront price without needing to provide further funds during the session) is enabled where few if any changes are required to either the game software or firmware of the gaming device 210. With virtual sessions, the game software need not be modified in order for a session to take place. Thus, an operator can provide session play capability without the need for a manufacturer's cooperation or permission. In general, exemplary embodiments of a virtual session described herein allow a server 110 to "push", transmit or otherwise provide credits as required to a gaming device 210 via a network to enable a session of game play on a gaming device 210. As the pushing of credits takes place without a required action by a player of the gaming device 210 on which the session or a portion of the session are being played, a virtual session is enabled that does not require changes to the software or hardware of the gaming device 210.

Figure 4:
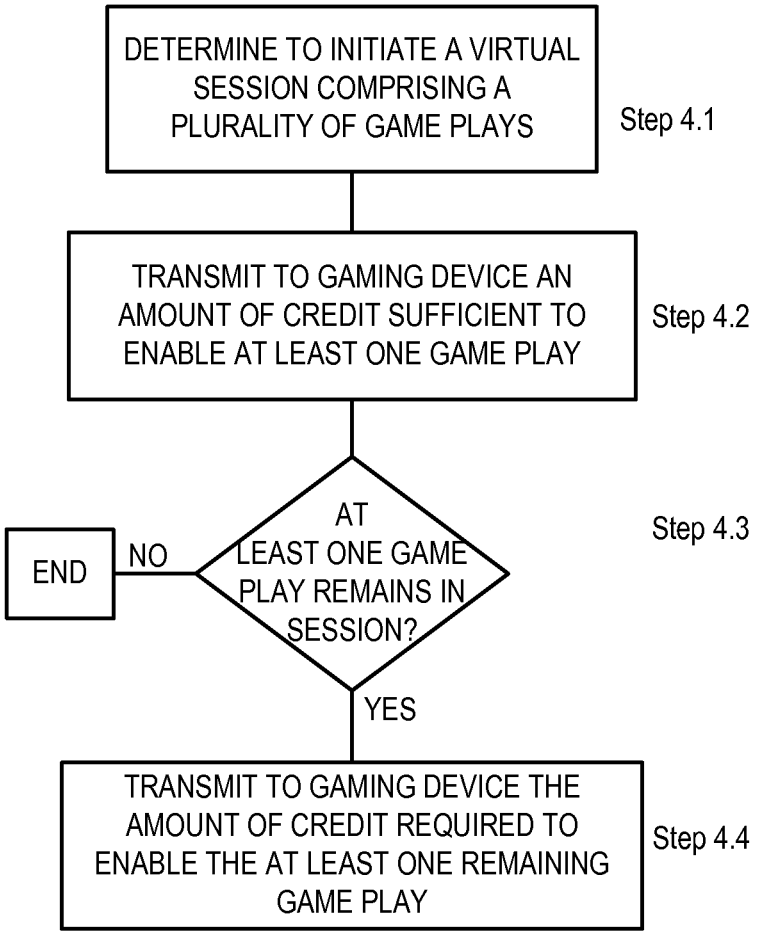
FIG. 4 is a flowchart of an exemplary and non-limiting embodiment described herein.

With reference to FIG. 4, there is illustrated an exemplary and non-limiting embodiment of a method by which virtual sessions may be implemented. At step 4.1, a determination is made, such as by the server 110 to initiate a virtual session. In exemplary embodiments, this determination may be the result of receiving a request from a gaming device 210 to initiate a virtual session. In yet another embodiment, for example where a gaming device 210 is configured to enable virtual sessions, the server 110 may initiate play at the gaming device 210 in accordance with a virtual session thus obviating any communication from the gaming device 210 to initiate a virtual session.

At step 4.2, the server 110 transmits an amount of credit to the gaming device 210 sufficient to enable at least one game play. In an exemplary embodiment, the amount of transmitted credits may be an amount required to initiate the virtual session.

In another exemplary embodiment, payment for a virtual session may be received, such as at the gaming device 210, to establish an initial credit balance that is used to initiate a virtual session. In such an instance, the server 110 monitors game play on the gaming device 210 and pushes additional credits to the gaming device in the event that the initial credit balance is depleted and additional money, points, or credits won by the player are insufficient to cover additional game plays remaining in the virtual session.

At step 4.3, a determination is made, such as by the server 110, if there remain any unplayed game plays in the virtual session. If there are no more game plays remaining in the virtual session, the virtual session ends. If, however, it is determined that there are remaining game plays in the virtual session, the server 110 continues, at step 4.4, to transmit additional credits to the gaming device 210 in amounts sufficient to continue game play until such time as the session is terminated.

Since the game software, such as is embodied, for example, in the program 270 of the gaming device 210, is untouched, the credit meter 345, which is controlled by the game/gaming device 210 and/or server 110 may be configured so as not to go negative as may be permitted to happen in a non-virtual session. Specifically, mathematics sometimes dictates that, in order to remain a traditional house edge in a session comprising a predetermined number of game plays, the credit meter balance may need be allowed to enter into negative territory via a negative balance. Details of such negative balances may be found, for example, as described in Walker et al. (US-2007-0087818-A1) which is incorporated in its entirety by reference herein. In such an instance, a player ending a session with a negative balance may walk away without incurring a penalty for the negative balance or without needing to repay the negative balance. However, market research has indicated that, in some instances, players are dissatisfied playing for a period of time with a negative balance. It has been discovered that in such sessions, the operation of the credit meter may be altered to eliminate the possibility of the credit meter acquiring a negative value, however, such an alteration requires that fewer hands or spins be offered for a given session price. As a result, while some exemplary embodiments may reduce the quantity of hands or spins than could otherwise be sold for a fixed price, there is reduced player dissatisfaction as might result from playing with a negative balance. Regardless, exemplary embodiments are configured to provide virtual sessions of a length of time and/or number of plays sufficient to offer players an experience of requisite value.

Exemplary and non-limiting embodiments enable virtual sessions using a software-driven promotion-credit push (PCP) system. In effect, a custom bonusing module may form a part of a server 110, thereby establishing the parameters of a virtual session. During the virtual session, a stream of promotional credits is "pushed" to the gaming device 210 in amounts calibrated to "sustain" the virtual session to its conclusion.

As but one example, a player sits down at a gaming device to play Texas Tea™. The player selects a nickel denomination from the available denomination choices. A window, such as on display device 235, opens and offers the player the option to purchase a virtual session of 200 spins of nine-line nickel play of Texas Tea™ for $20 or 300 spins of nine-line nickel play for $20 plus 100 player points. The player uses the system 100 to indicate a $20/200 spin choice and pays for the session by inserting a $20 bill.

A Texas Tea™ game appears in a window on display device 235. The $20 has been applied to the cost of the virtual session. The system 100 sets up a virtual session in the central system software of server 110. A Session Counter showing "100 SPINS" is displayed to the player. The display remains resident at the gaming device 210 during the virtual session, but can be closed at any time by the player.

Each spin requires nine credits be available on the credit meter. Thus, to start the virtual session, nine credits are pushed from the server 110 to the gaming device 210. This enables the player to make a first spin without putting any additional money into the gaming device 210. After the reels spin, the system instructs the displayed Session Counter to reduce the remaining spins by one. The Session Counter thus shows "99 SPINS" remaining. As described more fully below, any pushing of credits from the server 110 to the gaming device 210 may comprise pushing promotional credits provided by the casino absent payment for such credits by the player.

If the player wins nine or more credits on the spin, no additional promotional credits are pushed to fund the next spin. The player uses the positive credit balance to spin again. (Alternatively, the player may always choose to cash out early and end the session by collecting his winnings).

If the player loses on all nine lines, the credit meter is back to zero. In this case, the system 100 determines that the gaming device 210 has a zero balance and pushes nine more promotional credits to fund the next spin. If the player wins more than one but less than nine credits, sufficient credits are pushed to the gaming device 210 to fund the total difference up to the nine credits needed for the next spin in the virtual session. The funding process is repeated as often as needed until the Session Counter reaches zero at which time the player is notified, such as via a message displayed on the display device 235, that the virtual session has ended and no more promotional credits are pushed.

If the credit balance is positive at the end of the virtual session, the player may continue to play the gaming device 210 using available credits. There is no need to start a new virtual session or cash out the virtual session balance.

If the player tries to bet more coins than the player's virtual session purchase allowed for, the server 110 may discern the player's attempt and transmit a warning message for display at the gaming device 210 before engaging the reels. Alternatively, the spin might proceed, but only if the player had previously won enough credits to pay for the larger bet. For example, if the player has only twelve credits on his meter he would not be able to engage a spin for three coins on nine lines (27 credits needed).

In accordance with exemplary embodiments of virtual sessions wherein the credit balance is not permitted to go negative, no change is required to the way the gaming device 210 would otherwise display the credit balance were it operate under standard play. A casino may determine in advance whether or not to offer some amount of player points for those spins that were funded by promotional credits. For example, the system could calculate whether a given spin would have been funded by the original $20 bankroll. If so, player points are awarded. If not, the extra free spins earn no points.

Server 110 software may allow for suspend-and-restart sessions since all relevant data regarding the virtual session can be stored for access by the server 110.

For example, a player who wants to suspend a session having completed 62 out of 100 spins may indicate a desire to do so via an input device 240. If the gaming device 210 credit balance is zero at the time of suspension, then the restarted virtual session at any future time will simply be restarted with a zero balance and up to 38 spins remaining.

If the credit balance was positive at the time of suspension, the player would be asked to enter sufficient funds to re-create the positive balance before the session is re-started. In this way, the player must use up the previous positive balance before the player is eligible to receive any additional pushed credits. (If the player inserted more money than needed, a partial cashout ticket could be issued to the player in order to ensure that the virtual session was restarted with the exact credit balances in place as when it was suspended.)

As described in the exemplary and non-limiting embodiments above, virtual sessions require relatively few (if any) changes to existing gaming devices 210. Virtual sessions may be implemented on any game on any gaming device 210 supported by the system 100 where promotional credits can be sent to a gaming device 210 on an as-needed basis. Since the session is completely virtual, there exists a variety of achievable virtual session configurations and prices.

In yet another exemplary embodiment, more than one gaming device 210 could draw from the spin balance of a single purchased session. Thus, a player might purchase 1,000 spins of nine-line nickel Texas Tea™ and two different players might draw off the balance until the 1,000 spins are used up. The final reconciliation of point balances would be handled by the system software as would the management of the last few spins in the session to prevent overdrawing the total number of spins allowed.

For many players, "sessions of gaming" expressed in familiar blocks of "time" (vs. a packaged quantity of spins) are more appealing and easier to understand and plan around. For example, players often budget their entertainment based on their amount of available time. Being able to purchase "time on device" is an attractive choice for a large segment of consumers, especially those who might be worried about the uncertainty associated with losing too much or too quickly.

Similar to the exemplary embodiments described above with respect to virtual sessions, virtual time sessions comprising a predetermined block of time may be sold for any game on a gaming device 210 playable using the gaming system 100 with few if any changes required to the firmware or software operating on the gaming device 210.

Figure 5:
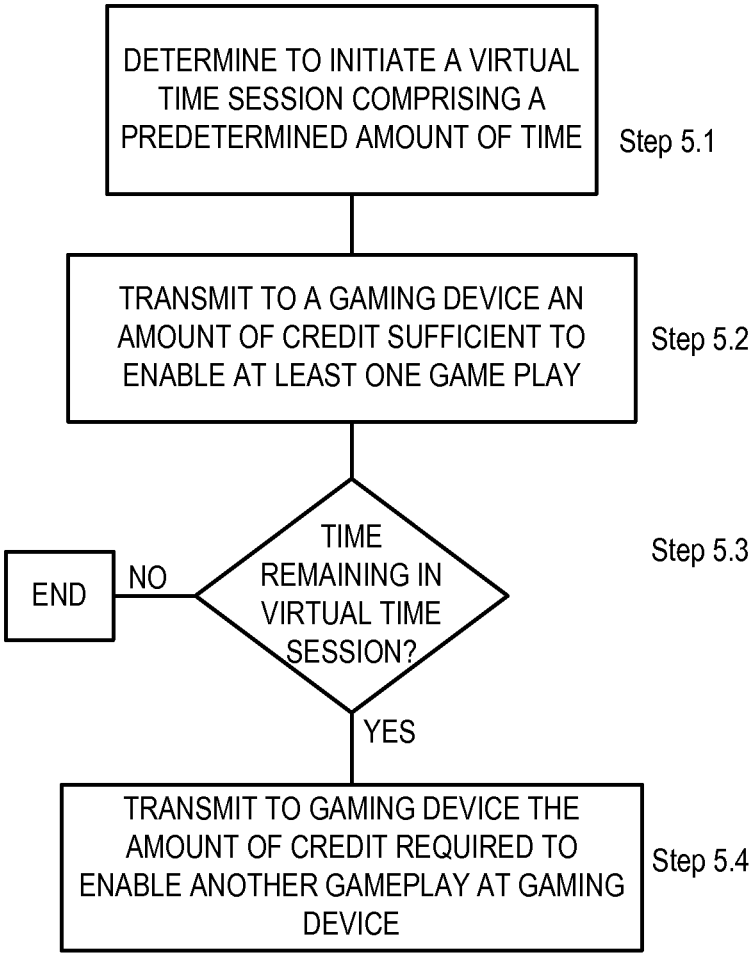
FIG. 5 is a flowchart of an exemplary and non-limiting embodiment described herein.

With reference to FIG. 5, there is illustrated an exemplary and non-limiting embodiment of a method by which virtual time sessions may be implemented. As used herein, "virtual time sessions" refer to virtual sessions that comprise a predetermined duration of time. At step 5.1, a determination is made, such as by the server 110, to initiate a virtual time session. In exemplary embodiments, this determination may be the result of receiving a request from a gaming device 210 to initiate a virtual time session. In yet another embodiment, for example where a gaming device 210 is configured to enable virtual time sessions, the server 110 may initiate play at the gaming device 210 in accordance with a virtual time session thus obviating any communication from the gaming device 210 to initiate a virtual time session.

At step 5.2, the server 110 transmits an amount of credit to the gaming device 210 sufficient to enable at least one game play. In an exemplary embodiment, the amount of transmitted credits may an amount required to initiate the virtual time session.

In another exemplary embodiment, payment for a virtual time session may be received, such as at the gaming device 210, to establish an initial credit balance that is used to initiate a virtual time session. In such an instance, the server 110 monitors game play on the gaming device 210 and pushes additional credits to the gaming device in the event that the initial credit balance is depleted and additional money, points, or credits won by the player are insufficient to cover additional game plays remaining in the virtual time session.

At step 5.3, a determination is made, such as by the server 110, if there remains any additional time in the in the virtual time session. If there is no more time remaining in the virtual time session, the virtual time session ends. If, however, it is determined that there is time remaining in the virtual time session, the server 110 continues, at step 5.4, to transmit additional credits to the gaming device 210 in amounts sufficient to continue game play until such time as the virtual time session is terminated.

In general, exemplary embodiments of virtual time sessions may not permit the credit meter to go below zero during the virtual time session and the virtual time session length is denominated in time instead of a specific quantity of spins (or hands). As described with reference to virtual sessions, virtual time sessions use the same promotional-credit push (PCP) system to sustain a virtual time session during its active period. Each virtual time session has a pre-set coin value and a specific number of lines (e.g., nine-line nickel play). A fixed price may be paid for convenient blocks of time such as 15 minutes, 30 minutes and 1 hour.

In one exemplary embodiment, a clock appears on a display device 235 at the start the virtual time session. The clock begins its countdown with the first spin. To prevent the player feeling continuous time pressure, the clock may show full minutes remaining (perhaps with an analog second hand or other graphic) until the final three minutes. In the final minutes the clock may digitally show both minutes and seconds remaining, according to some embodiments.

In an exemplary embodiment, the player may pause the clock for up to "x" minutes up to "y" times in a session simply by pressing a pause button or other input device 240. The clock automatically resumes when the player presses the spin key or otherwise resumes the virtual time session. If a paused virtual time session is not resumed, it is stored on the network, such as by the server 110, for the player to claim at a later time. The game or games operating on the gaming device 210 during the virtual time session should be set so that the player cannot spin/stop the reels at a rate faster than every few seconds. (This might require disabling the fast-stop double press of the spin button, or otherwise engaging the reels for at least a predetermined amount of time prior to resolving a given spin.)

Suspended and restarted virtual time sessions may be handled in the same manner as described above with reference to virtual sessions. In exemplary embodiments, when the clock reaches zero, automatic funding of promotional credits would stop unless the player purchased a virtual time session extension. The player could then continue to play with any positive credit balance he had on the meter.

In accordance with the various embodiments of virtual sessions, including virtual time sessions, described above, a variety of short promotional sessions can be created with no need to pre-program them into the firmware of gaming devices 210. In accordance with embodiments wherein the virtual sessions are initiated with a credit balance of zero or an amount sufficient to enable only a single game play and wherein the virtual session further does not permit a credit balance to go negative, either giving away or selling short sessions offers operators a 50-80% discount compared to the cost of typical promotional credits that can be played once and then redeemed for cash.

For example, to give a player 20 spins of nine-line nickel play (9 lines×5¢=45¢ per spin) would normally require 20 spins×45¢=$9.00. Thus $9.00 of promotional credits would be loaded onto the gaming device 210. The player could play these promotional credits once and then be allowed to cash out the balance. Depending on taxes and comps, promotional credits typically cost the casino near cash value. Ignoring taxes and comps and assuming a 10% floor hold the $9.00 in promotional credits cost the casino $8.10. Some casinos will have to pay taxes on the $0.90 win and some will provide comps. Assuming a 10% tax rate and 20% comp rate the cost of $9.00 is closer to $8.50.

Giving the same player 20 spins with a zero-credit start will cost the casino far less since the player cannot just run the promotional credits through once and then cash out a balance. The maximum contract cost of a 45¢ 20-spin session (with a meter that never goes negative but is refreshed after each spin if needed) is $2.50.

In this example there would be a 70% reduction in promotion costs.

Because all sessions are virtual, it becomes much easier to create and test a wide variety of different promotional session offers to see which ones work best.

Furthermore, promotional session characteristics can be personalized by player preference. Some players may prefer to get more spins but fewer lines while others would rather have more lines and fewer spins.

Promotional sessions do not need to be given away free, They can be sold at subsidized or break-even rates in order to encourage trial of new games.

Currently, players must absorb all trial costs of a new game themselves. For many games, that means $20 or more must be risked to find out if the game is "lucky" or fun. This runs counter to known consumer marketing principles which has established, generally, that if you want people to buy a new product, it is preferable to provide a way they can try it either for free or inexpensively.

Promotional sessions could also be set up in tournament mode to reduce costs and increase excitement even further. In tournament mode, the credit meter shows non-cashable credits. This allows a session to be set up so that the player wins a certain cash value only if he achieves a threshold level of credits during the session. Though tournament mode typically increases the payout frequency and value, the system 100 could be set up so that normal frequencies and payouts apply. (See Matt)

For example, a player receives a promotional FREE TRIAL ticket good for 50 spins of 20-line penny play on the new Wolf Run II™ game. After the player inserts the ticket, a window opens, such as on a display device 235, and tells the player that the ticket is good for a "personal tournament." After 50 spins, if the credit meter reaches 100 credits, the player wins $100. (Results of less than 100 credits have no value.)

The player must press YES in the window to indicate that the player understands what the ticket is good for. The window stays open for all spins during the personal tournament so there is no confusion that the game is promotional credit mode.

Since it is relatively difficult to spin 50 times and end up with a 100-credit balance, the contract cost for this promotion is just $1.25. The player gets the chance to experience 100 spins of a new game, and even if he did not meet the prize threshold, if his credit balance ends up at 30 or 40, he will consider the game lucky and be much more likely to take out $20 and give it a try.

What is claimed is:

1. A method of operating a server, said method comprising:

(a) causing at least one server processor to execute a plurality of instructions stored in at least one memory device to receive a request from a gaming device to initiate a session of game play including a plurality of game plays to be played for a player who purchased said session of game play for a monetary value following receipt of a first physical item by an acceptor of the gaming device, said first physical item being associated with the monetary value;

b) after receiving the request and prior to initiating any of the plurality of game plays to be played, without receiving any funds from the player in addition to the monetary value associated with the received first physical item, causing the at least one server processor to execute the plurality of instructions to transmit to the gaming device a first amount of credit required to initiate a first game play of the session on the gaming device without causing the at least one server processor to execute the plurality of instructions to transmit to the gaming device any amount of credit required to initiate any subsequent game play of the session on the gaming device;

(c) causing the at least one server processor to execute the plurality of instructions to transmit to the gaming device a session counter indicating a number of the plurality of game plays remaining in the session;

(d) causing the at least one server processor to execute the plurality of instructions to determine whether to transmit an additional amount of credit to the gaming device to enable at least one of the plurality of game plays remaining to be played; and (e) if it is determined to transmit the additional amount of credit to the gaming device, causing the at least one server processor to execute the plurality of instructions to transmit to the gaming device the additional amount of credit required to enable the at least one of the plurality of game plays remaining to be played without receiving any funds from the player in addition to the monetary value.

2. The method of claim 1 wherein the additional amount of credit includes a promotional credit.

3. The method of claim 2 further including causing the at least one server processor to execute the plurality of instructions to cause a benefit to be awarded to the player for game plays enabled by the promotional credit.

4. The method of claim 3 wherein the benefit includes at least one player point.

5. The method of claim 1 further including causing the at least one server processor to execute the plurality of instructions to transmit a message to the player if the at least one server processor determines not to transmit the additional amount of credit.

6. A non-transitory computer readable medium storing instructions configured to direct a server processor to perform a method comprising:

(a) receiving a request from a gaming device to initiate a session of game play including a plurality of game plays to be played for a player who purchased said session of game play for a monetary value following receipt of a first physical item by an acceptor of the gaming device, said first physical item being associated with the monetary value;

b) after receiving the request and prior to initiating any of the plurality of game plays to be played, without receiving any funds from the player in addition to the monetary value associated with the received first physical item, transmitting to the gaming device a first amount of credit required to initiate a first game play of the session on the gaming device without transmitting to the gaming device any amount of credit required to initiate any subsequent game play of the session on the gaming device;

(c) determining whether to transmit an additional amount of credit to the gaming device to enable at least one of the plurality of game plays remaining to be played; and (d) if it is determined to transmit the additional amount of credit to the gaming device, transmitting to the gaming device the additional amount of credit required to enable the at least one of the plurality of game plays remaining to be played without receiving any funds from the player in addition to the monetary value.

7. A server comprising:

at least one server processor; and at least one memory device storing a plurality of instructions which, when executed by the at least one server processor, cause the at least one server processor to:

(a) receive a request from a gaming device to initiate a session of game play including a plurality of game plays to be played for a player who purchased said session of game play for a monetary value following receipt of a first physical item by an acceptor of the gaming device, said first physical item being associated with the monetary value;

b) after receiving the request and prior to initiating any of the plurality of game plays to be played, without receiving any funds from the player in addition to the monetary value associated with the received first physical item, transmit to the gaming device a first amount of credit required to initiate a first game play of the session on the gaming device without transmitting to the gaming device any amount of credit required to initiate any subsequent game play of the session on the gaming device;

(c) determine whether to transmit an additional amount of credit to the gaming device to enable at least one of the plurality of game plays remaining to be played; and (d) if it is determined to transmit the additional amount of credit to the gaming device, transmit to the gaming device the additional amount of credit required to enable the at least one of the plurality of game plays remaining to be played without receiving any funds from the player in addition to the monetary value.

8. A method of operating a gaming device, said method comprising:

(a) receiving, via an acceptor of the gaming device, a physical item associated with a first monetary value;

b) receiving, via at least one input device of the gaming device and from a player, a payment of a second monetary value, said second monetary value being deducted from the first monetary value associated with the received physical item;

(c) causing at least one gaming device processor to execute a plurality of instructions stored in at least one memory device to, in response to receiving the payment, transmit to a server a request from the gaming device to initiate a session of game play including a plurality of game plays to be played for the player;

(d) after receiving the request and prior to initiating any of the plurality of game plays to be played, without receiving any funds from the player in addition to the payment of the second monetary value, causing the at least one gaming device processor to execute the plurality of instructions to receive, from the server, a first amount of credit required to initiate a first game play of the session on the gaming device without causing the at least one gaming device processor to receive, from the server, any amount of credit required to initiate any subsequent game play of the session on the gaming device;

(e) causing the at least one gaming device processor to execute the plurality of instructions to receive, from the server, a session counter indicating a number of the plurality of game plays remaining in the session;

(f) causing the at least one gaming device processor to execute the plurality of instructions to transmit to the server a requirement for an additional amount of credit to enable at least one of the plurality of game plays remaining to be played; and (g) causing the at least one gaming device processor to execute the plurality of instructions to receive, from the server, the additional amount of credit required to enable the at least one of the plurality of game plays remaining to be played without receiving any funds from the player in addition to the second monetary value.

9. The method of claim 8 further including causing the at least one gaming device processor to execute the plurality of instructions to operate with at least one display device to display the session counter on the gaming device.

10. The method of claim 8 wherein the additional amount of credit includes a promotional credit.

11. A non-transitory computer readable medium storing instructions configured to direct a gaming device processor to perform a method comprising:

(a) receiving, via an acceptor of the gaming device, a physical item associated with a first monetary value;

(b) receiving, via at least one input device of the gaming device and from a player, a payment of a second monetary value, said second monetary value being deducted from the first monetary value associated with the received physical item;

(c) in response to receiving the payment, transmitting to a server a request from a gaming device to initiate a session of game play including a plurality of game plays to be played for the player;

(d) after receiving the request and prior to initiating any of the plurality of game plays to be played, without receiving any funds from the player in addition to the payment of the second monetary value, receiving from the server a first amount of credit required to initiate a first game play of the session on the gaming device without receiving from the server any amount of credit required to initiate any subsequent game play of the session on the gaming device;

(e) transmitting to the server a requirement for an additional amount of credit to enable at least one of the plurality of game plays remaining to be played; and (f) receiving, from the server, the additional amount of credit required to enable the at least one of the plurality of game plays remaining to be played without receiving any funds from the player in addition to the second monetary value.

12. A gaming device comprising:

at least one gaming device processor;

a plurality of input devices including an acceptor; and at least one memory device storing a plurality of instructions which, when executed by the at least one gaming device processor, cause the at least one gaming device processor to operate with the plurality of input devices to:

(a) receive, via the acceptor, a physical item associated with a first monetary value;

(b) receive, from a player, a payment of a second monetary value, said second monetary value being deducted from the first monetary value associated with the received physical item;

(c) in response to receiving the payment, transmit to a server a request from the gaming device to initiate a session of game play including a plurality of game plays to be played for the player;

(d) after receiving the request and prior to initiating any of the plurality of game plays to be played, without receiving any funds from the player in addition to the payment of the second monetary value, receive from the server a first amount of credit required to initiate a first game play of the session on the gaming device without receiving from the server any amount of credit required to initiate any subsequent game play of the session on the gaming device;

(e) transmit to the server a requirement for an additional amount of credit to enable at least one of the plurality of game plays remaining to be played; and (f) receive, from the server, the additional amount of credit required to enable the at least one of the plurality of game plays remaining to be played without receiving any funds from the player in addition to the second monetary value.

13. A method of operating a server, said method comprising:

(a) causing at least one server processor to execute a plurality of instructions stored in at least one memory device to receive a request from a gaming device to initiate a session of game play including a predetermined duration for a player who purchased said session of game play for a monetary value following receipt of a first physical item by an acceptor of the gaming device;

(b) after receiving the request and prior to initiating any of the plurality of game plays to be played, without receiving any funds from the player in addition to the monetary value associated with the received first physical item, causing the at least one server processor to execute the plurality of instructions to transmit to the gaming device a first amount of credit required to initiate a first game play of the session on the gaming device without causing the at least one processor to execute the plurality of instructions to transmit to the gaming device any amount of credit required to initiate any subsequent game play of the session on the gaming device;

(c) causing the at least one server processor to execute the plurality of instructions to transmit to the gaming device a session timer indicating an amount of time remaining in the session;

(d) causing the at least one server processor to execute the plurality of instructions to determine if the predetermined period of time has expired; and (e) causing the at least one server processor to execute the plurality of instructions to transmit to the gaming device an additional amount of credit required to enable game play if the predetermined duration has not expired without receiving any funds from the player in addition to the monetary value.

14. The method of claim 13 wherein the additional amount of credit includes a promotional credit.

15. The method of claim 14 further including causing the at least one server processor to execute the plurality of instructions to cause a benefit to be awarded to the player for game plays enabled by the promotional credit.

16. The method of claim 15 wherein the benefit includes at least one player point.

17. The method of claim 13 further including causing the at least one server processor to execute the plurality of instructions to transmit a message to the player if it is determined not to transmit the additional amount of credit.

18. A non-transitory computer readable medium storing instructions configured to direct a server processor to perform a method comprising:

(a) receiving a request from a gaming device to initiate a session of game play including a predetermined duration for a player who purchased said session of game play for a monetary value following receipt of a first physical item by an acceptor of the gaming device;

(b) after receiving the request and prior to initiating any of the plurality of game plays to be played, without receiving any funds from the player in addition to the monetary value associated with the received first physical item, transmitting to the gaming device a first amount of credit required to initiate a first game play of the session on the gaming device without transmitting to the gaming device any amount of credit required to initiate any subsequent game play of the session on the gaming device (c) determining if the predetermined period of time has expired; and (d) transmitting to the gaming device an additional amount of credit required to enable game play if the predetermined duration has not expired without receiving any funds from the player in addition to the monetary value.

19. A server comprising:

at least one server processor; and at least one memory device storing a plurality of instructions which, when executed by the at least one server processor, cause the at least one server processor to:

(a) receive a request from a gaming device to initiate a session of game play including a predetermined duration for a player who purchased said session of game play for a monetary value following receipt of a first physical item by an acceptor of the gaming device;

(b) after receiving the request and prior to initiating any of the plurality of game plays to be played, without receiving any funds from the player in addition to the monetary value associated with the received first physical item, transmit to the gaming device a first amount of credit required to initiate a first game play of the session on the gaming device without transmitting to the gaming device any amount of credit required to initiate any subsequent game play of the session on the gaming device (c) determine if the predetermined period of time has expired; and (d) transmit to the gaming device an additional amount of credit required to enable game play if the predetermined duration has not expired without receiving any funds from the player in addition to the monetary value.

20. A method of operating a gaming device, said method comprising:

(a) receiving, via an acceptor of the gaming device, a physical item associated with a first monetary value;

(b) receiving, via at least one input device of the gaming device and from a player, a payment of a second monetary value, said second monetary value being deducted from the first monetary value associated with the received physical item;

(c) in response to receiving the payment, causing at least one gaming device processor to execute a plurality of instructions stored in at least one memory device to transmit to a server a request from the gaming device to initiate a session of game play including a predetermined duration for the player;

(d) after receiving the request and prior to initiating any of the plurality of game plays to be played, without receiving any funds from the player in addition to the payment of the second monetary value, causing the at least one gaming device processor to execute the plurality of instructions to receive, from the server, a first amount of credit required to initiate a first game play of the session on the gaming device without causing the at least one gaming device processor to execute the plurality of instructions to receive, from the server, any amount of credit required to initiate any subsequent game play of the session on the gaming device;

(e) causing the at least one gaming device processor to execute the plurality of instructions to receive, from the server, a session timer indicating an amount of time remaining in the session;

(f) causing the at least one gaming device processor to execute the plurality of instructions to transmit to the server a requirement for an additional amount of credit to enable at least one remaining game play; and (g) receiving, from the server, the additional amount of credit required to enable the at least one remaining game play to be played without receiving any funds from the player in addition to the second monetary value.

21. The method of claim 20 further including causing the at least one gaming device processor to execute the plurality of instructions to operate with at least one display device to display the session timer on the gaming device.

22. The method of claim 20 wherein the additional amount of credit includes a promotional credit.

23. A non-transitory computer readable medium storing instructions configured to direct a gaming device processor to perform a method comprising:

(a) receiving, via an acceptor of the gaming device, a physical item associated with a first monetary value;

(b) receiving, via at least one input device of the gaming device and from a player, a payment of a second monetary value, said first physical item being associated with the monetary value;

(c) in response to receiving the payment, transmitting to a server a request from a gaming device to initiate a session of game play including a predetermined duration for the player;

(d) after receiving the request and prior to initiating any of the plurality of game plays to be played, without receiving any funds from the player in addition to the payment of the second monetary value, receiving from the server a first amount of credit required to initiate a first game play of the session on the gaming device without receiving from the server any amount of credit required to initiate any subsequent game play of the session on the gaming device;

(e) transmitting to the server a requirement for an additional amount of credit to enable at least one remaining game play; and (f) receiving, from the server, the additional amount of credit required to enable the at least one remaining game play to be played without receiving any funds from the player in addition to the second monetary value.

24. A gaming device comprising:

at least one gaming device processor;

a plurality of input devices including an acceptor; and at least one memory device storing a plurality of instructions which, when executed by the at least one gaming device processor, cause the at least one gaming device processor to operate with the plurality of input devices to:

(a) receive, via the acceptor, a physical item associated with a first monetary value;

(b) receive, from a player, a payment of a second monetary value, said second monetary value being deducted from the first monetary value associated with the received physical item;

(c) in response to receiving the payment, transmit to a server a request from the gaming device to initiate a session of game play including a predetermined duration for the player;

(d) after receiving the request and prior to initiating any of the plurality of game plays to be played, without receiving any funds from the player in addition to the payment of the second monetary value, receive from the server a first amount of credit required to initiate a first game play of the session on the gaming device without receiving from the server any amount of credit required to initiate any subsequent game play of the session on the gaming device;

(e) transmit to the server a requirement for an additional amount of credit to enable at least one remaining game play; and (f) receive, from the server, the additional amount of credit required to enable the at least one remaining game play to be played without receiving any funds from the player in addition to the second monetary value.

25. A method of operating a server comprising:

(a) causing at least one server processor to execute a plurality of instructions stored in at least one memory device to receive a request from a gaming device to initiate a session of game play including a plurality of game plays to be played following receipt of a first physical item associated with a monetary value by an acceptor of the gaming device;

(b) causing the at least one server processor to execute the plurality of instructions to determine an amount of credit required to initiate a first game play of the session on the gaming device, thereby determining a first amount of credit;

(c) causing the at least one server processor to execute the plurality of instructions to determine an amount of credit available for initiating the first game play on the gaming device, thereby determining a second amount of credit, the second amount of credit being stored in a memory of the gaming device;

(d) if the second amount is less than the first amount, causing the at least one server processor to execute the plurality of instructions to determine a third amount of credit necessary to be added to the second amount to cause a sum of the second amount and the third amount to equal to the first amount; and (e) after receiving the request and prior to initiating any of the plurality of game plays to be played, causing the at least one server processor to execute the plurality of instructions to, without receiving the third amount of credit from a player of the gaming device, transmit the determined third amount of credit to the gaming device without causing the at least one server processor to execute the plurality of instructions to transmit any amount of credit in addition to the determined third amount of credit to the gaming device.

26. A non-transitory computer readable medium storing instructions configured to direct a server processor to perform a method comprising:

(a) receiving a request from a gaming device to initiate a session of game play including a plurality of game plays to be played following receipt of a first physical item associated with a monetary value by an acceptor of the gaming device;

(b) determining an amount of credit required to initiate a first game play of the session on the gaming device, thereby determining a first amount of credit;

(c) determining an amount of credit available for initiating a first game play on the gaming device, thereby determining a second amount of credit, the second amount of credit being stored in a memory of the gaming device;

(d) if the second amount is less than the first amount, determining a third amount of credit necessary to be added to the second amount to cause a sum of the second amount and the third amount to equal to the first amount; and (e) after receiving the request and prior to initiating any of the plurality of game plays to be played, without receiving the third amount of credit from a player of the gaming device, transmitting the determined third amount of credit to the gaming device without transmitting any amount of credit in addition to the determined third amount of credit to the gaming device.

27. A server comprising:

at least one server processor; and at least one memory device storing a plurality of instructions which, when executed by the at least one server processor, cause the at least one server processor to:

(a) receive a request from a gaming device to initiate a session of game play including a plurality of game plays to be played following receipt of a first physical item associated with a monetary value by an acceptor of the gaming device;

(b) determine an amount of credit required to initiate a first game play of the session on the gaming device, thereby determining a first amount of credit;

(c) determine an amount of credit available for initiating a first game play on the gaming device, thereby determining a second amount of credit, the second amount of credit being stored in a memory of the gaming device;

(d) if the second amount is less than the first amount, determine a third amount of credit necessary to be added to the second amount to cause a sum of the second amount and the third amount to equal to the first amount; and (e) after receiving the request and prior to initiating any of the plurality of game plays to be played, without receiving the third amount of credit from a player of the gaming device, transmit the determined third amount of credit to the gaming device without transmitting any amount of credit in addition to the determined third amount of credit to the gaming device.

* * * * *